US011099496B2

(12) United States Patent
Kobayashi et al.

(10) Patent No.: US 11,099,496 B2
(45) Date of Patent: Aug. 24, 2021

(54) IMAGE FORMING APPARATUS

(71) Applicant: CANON KABUSHIKI KAISHA, Tokyo (JP)

(72) Inventors: Shinsuke Kobayashi, Yokohama (JP); Kensuke Umeda, Kawasaki (JP); Takanori Watanabe, Kawasaki (JP); Ai Suzuki, Tokyo (JP); Kazuhiro Funatani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/780,645

(22) Filed: Feb. 3, 2020

(65) Prior Publication Data

US 2020/0272069 A1 Aug. 27, 2020

(30) Foreign Application Priority Data

Feb. 26, 2019 (JP) ..... JP2019-033352

(51) Int. Cl.
*G03G 15/00* (2006.01)
*G03G 15/02* (2006.01)
*G03G 15/06* (2006.01)

(52) U.S. Cl.
CPC ..... *G03G 15/0225* (2013.01); *G03G 15/065* (2013.01)

(58) Field of Classification Search
CPC ..... G03G 15/161; G03G 2215/1661; G03G 21/0035; G03G 21/0011; G03G 21/0005
USPC ..... 399/71
See application file for complete search history.

(56) References Cited

U.S. PATENT DOCUMENTS 4,870,460 A * 9/1989 Harada ..... G03G 15/5037 399/49
5,426,488 A * 6/1995 Hayakawa ..... G03G 15/0216 361/225
6,549,742 B1 * 4/2003 Chigono ..... G03G 15/0241 361/225
2002/0159782 A1 * 10/2002 Tsuruya ..... G03G 15/0216 399/50

(Continued)

FOREIGN PATENT DOCUMENTS

JP 2017-72675 A 4/2017
JP 2017-187796 A 10/2017

*Primary Examiner* — Walter L Lindsay, Jr.
*Assistant Examiner* — Frederick Wenderoth
(74) *Attorney, Agent, or Firm* — Canon U.S.A., Inc. I.P. Division

(57) ABSTRACT

A charging member which is driven so that the surface of the charging member has a speed difference from the surface of an image bearing member. In a cleaning operation for cleaning the charging member by transferring toner adhering to the surface of the charging member from the charging member to the image bearing member and collecting the transferred toner with a developing member, a first charging voltage forming a potential difference between the charging member and the image bearing member is applied to the charging member, and then a second charging voltage having the same polarity as that of the first charging voltage and an absolute value greater than that of the first charging voltage is applied. The potential difference is in a direction in which electrostatic force directed from the charging member to the image bearing member acts on the toner charged to normal polarity.

27 Claims, 16 Drawing Sheets

(56) References Cited

U.S. PATENT DOCUMENTS

| | | | | |
|---|---|---|---|---|
| 2003/0095812 | A1* | 5/2003 | Nagamori | G03G 15/0233 399/176 |
| 2009/0060554 | A1* | 3/2009 | Kosuge | G03G 15/025 399/71 |
| 2012/0082475 | A1* | 4/2012 | Kawai | G03G 15/0225 399/100 |
| 2017/0075290 | A1* | 3/2017 | Hiramatsu | G03G 21/0064 |
| 2017/0090333 | A1* | 3/2017 | Ikeda | G03G 15/0225 |
| 2017/0242381 | A1* | 8/2017 | Hamada | G03G 21/0011 |

* cited by examiner

IMAGE FORMING APPARATUS

BACKGROUND

Field of the Disclosure

The present disclosure relates to an image forming apparatus using an electrophotographic recording method, such as a laser printer, a copying machine, and a facsimile machine.

Description of the Related Art

An electrophotographic image forming apparatus forms an electrostatic latent image on a photosensitive drum serving as an image bearing member by uniformly charging the photosensitive drum to a desired potential with a discharge between the photosensitive drum and a charging member, and then performing exposure based on an image pattern. The electrostatic latent image on the photosensitive drum is then developed and visualized with toner, and transferred to a recording material such as paper. Transfer residual toner remaining on the photosensitive drum is removed and collected from the photosensitive drum.

Contact-type charging devices in which a charging member is brought into contact with the photosensitive drum for charging are often used because of advantages such as low ozone production and low power consumption.

A cleaning device including a cleaning member such as a cleaning blade is widely used as a unit for removing and collecting transfer residual toner from the photosensitive drum. While the cleaning device collects most of the transfer residual toner, some of the transfer residual toner can slip through the cleaning blade and adhere to the charging member. Cleanerless systems in which no cleaning device is included and the transfer residual toner on the photosensitive drum is collected and reused by a developing device have been discussed in recent years. Since the cleanerless systems include no cleaning device, the transfer residual toner on the photosensitive drum is passed through a contact portion between the photosensitive drum and the charging member and conveyed to the developing device. If a contact charging system is used, the transfer residual toner can adhere to the charging member. A large amount of transfer residual toner can adhere to the charging member in a cleanerless image forming apparatus in particular.

Japanese Patent Application Laid-Open No. 2017-187796 discusses rotating a charging member and a photosensitive drum with a peripheral speed difference therebetween to charge toner adhering to the charging member to normal polarity by frictional sliding. The toner adhering to the charging member and charged to the normal polarity is transferred and collected to the photosensitive drum by a potential difference between the charging member and the surface potential of the photosensitive drum in a cleaning operation Image defects caused by poor charging due to adhering toner can thereby be reduced.

In the image forming apparatus of a contact charging system, potentials can also be formed on the photosensitive drum by injection charging. Injection charging is particularly likely to occur in a configuration where the charging member and the photosensitive drum have a peripheral speed difference therebetween as discussed in Japanese Patent Application Laid-Open No. 2017-187796, and in in a case of presence of low resistance substances adhering to the surface of the photosensitive drum. According to Japanese Patent Application Laid-Open No. 2017-187796, the surface potential of the photosensitive drum approaches the charging voltage due to injection charging caused by frictional sliding between the charging member and the photosensitive drum, and the potential difference between the charging member and the surface of the photosensitive drum decreases. This makes an electric field desirable for the transfer of the toner charged to the normal polarity to the photosensitive drum difficult to obtain, and has sometimes resulted in image defects due to poor charging because the toner fails to be effectively transferred from the charging member to the photosensitive drum during the cleaning operation.

SUMMARY OF THE DISCLOSURE

The present disclosure is directed to a technique capable of maintaining, in a cleaning operation of an image forming apparatus of a contact charging system where a photosensitive drum is subjected to injection charging, a potential difference between a charging member and the surface of the photosensitive drum so that toner adhering to the charging member is transferred to the photosensitive drum to prevent image defects.

According to a first aspect of the present disclosure, an image forming apparatus that forms a toner image on a recording material, includes a rotatable image bearing member, a charging member configured to make contact with the image bearing member to form a charging portion, and charge a surface of the image bearing member at the charging portion, a driving source configured to transmit a driving force to the charging member, a voltage application unit configured to apply a charging voltage to the charging member, a developing member configured to make contact with the image bearing member to form a developing portion, and supply toner charged to normal polarity to the image bearing member to form a toner image at the developing portion, a transfer member configured to make contact with the image bearing member to form a transfer portion, and transfer the toner image formed on the surface of the image bearing member to a recording material at the transfer portion, and a control unit configured to control the voltage application unit, wherein the charging member is driven so that a surface of the charging member has a speed difference from the surface of the image bearing member, wherein the control unit is configured to control an image forming operation for forming the toner image on the recording material and a cleaning operation for cleaning the charging member by transferring toner adhering to the surface of the charging member from the charging member to the image bearing member and collecting the transferred toner with the developing member, to be executed, and wherein the control unit is configured to control the voltage application unit so that, in the cleaning operation, a first charging voltage forming a potential difference between the charging member and the image bearing member is applied to the charging member, and then a second charging voltage having the same polarity as that of the first charging voltage and an absolute value greater than that of the first charging voltage is applied, the potential difference being in a direction in which electrostatic force directed from the charging member to the image bearing member acts on the toner charged to the normal polarity.

Further features of the present disclosure will become apparent from the following description of exemplary embodiments with reference to the attached drawings.

DESCRIPTION OF THE EMBODIMENTS

Exemplary embodiments of the present disclosure will be described in detail below with reference to the drawings. Dimensions, materials, shapes, and relative arrangements of components described in the following exemplary embodiments are subject to appropriate modifications depending on the configurations and various conditions of apparatuses to which the exemplary embodiments are applied. The scope of the present disclosure is therefore not limited thereto unless otherwise specified.

Image forming apparatuses according to the exemplary embodiments of the present disclosure will be described in more details below with reference to the drawings.

1. Image Forming Apparatus

Figure 1:
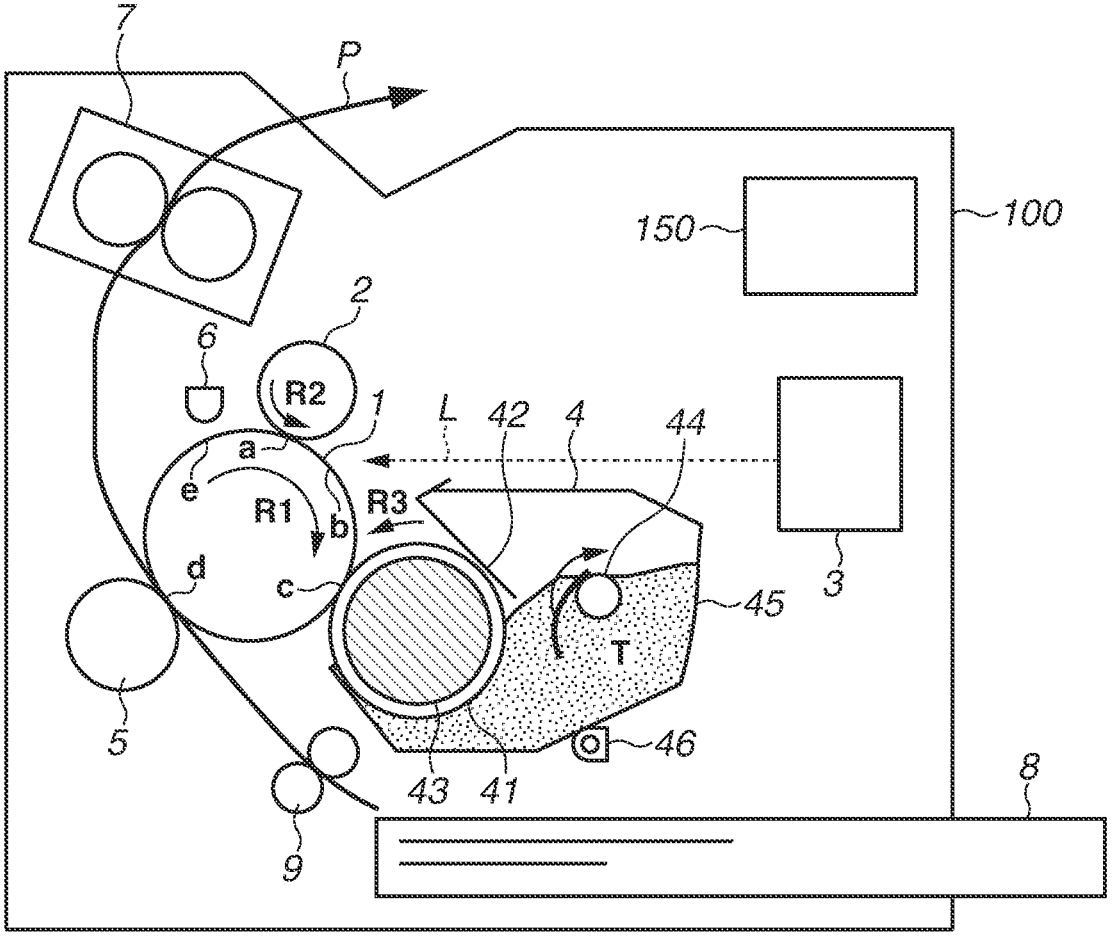
FIG. 1 is a diagram illustrating an image forming apparatus according to a first exemplary embodiment.

FIG. 1 is a diagram illustrating a schematic configuration of an image forming apparatus 100 according to a first exemplary embodiment of the present disclosure. The image forming apparatus 100 according to the first exemplary embodiment is an electrophotographic laser beam printer employing a cleanerless system and a contact charging system.

Figure 2:
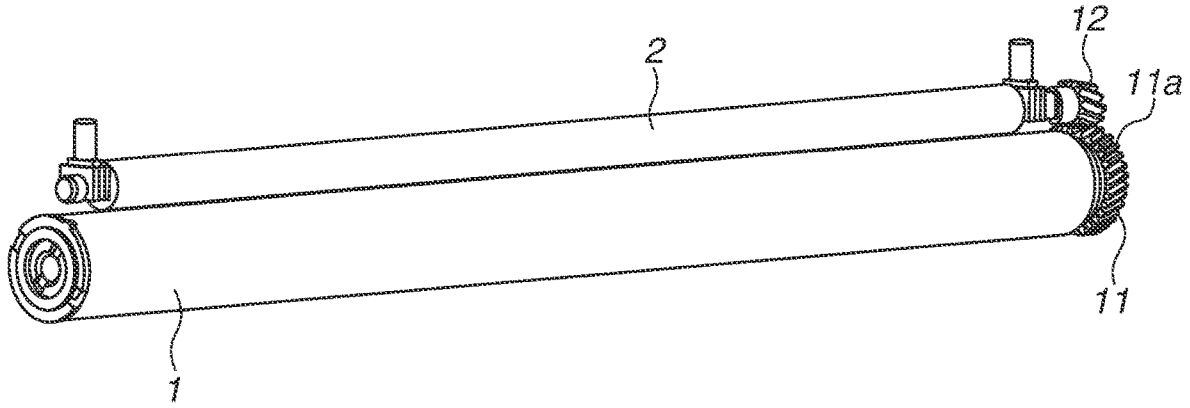
FIG. 2 is a configuration layout diagram of a photosensitive drum and a charging roller according to the first exemplary embodiment.
Figure 3:
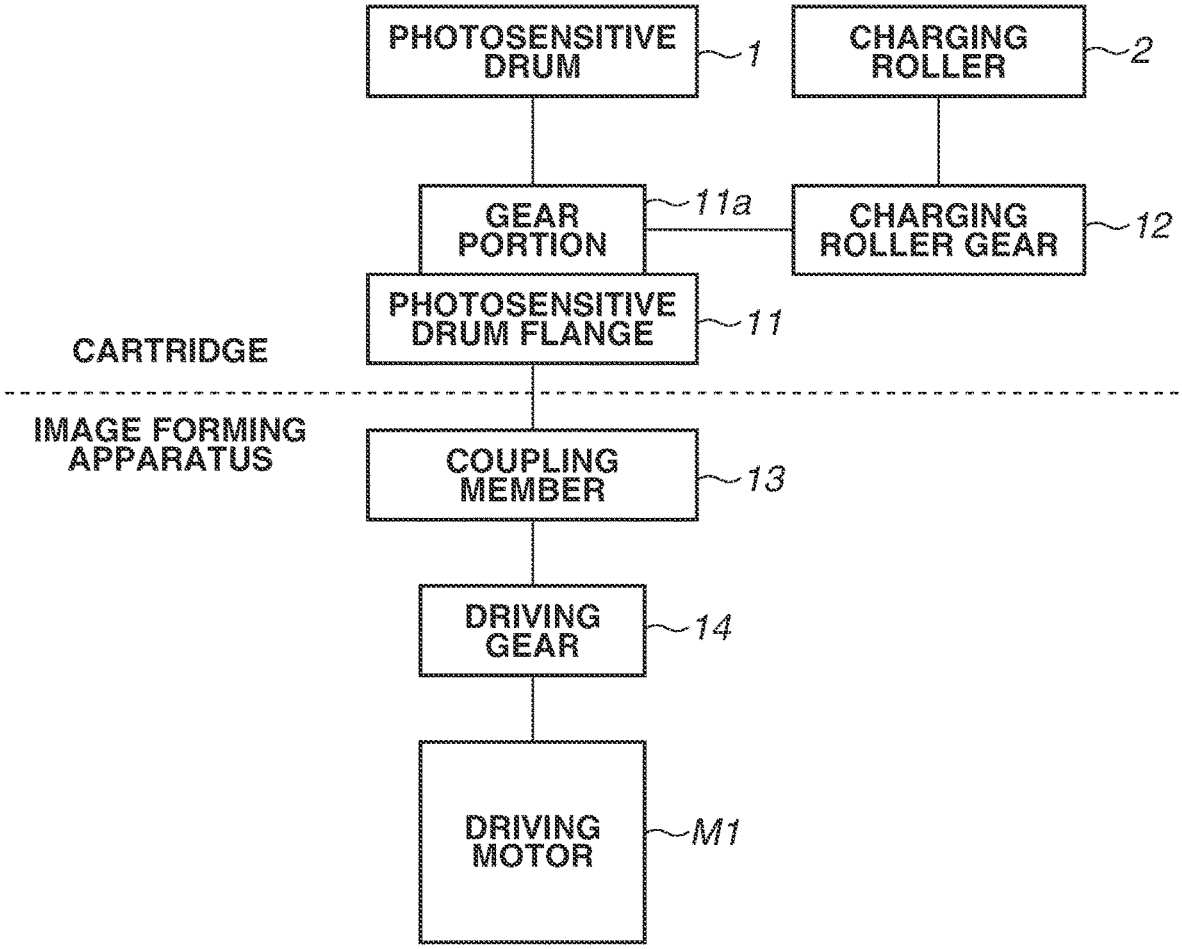
FIG. 3 is a driving block diagram of the photosensitive drum and the charging roller according to the first exemplary embodiment.

The image forming apparatus 100 includes a photosensitive drum 1, which is a drum-shaped (cylindrical) electrophotographic photosensitive member serving as a rotatable image bearing member. When an image output operation is started, driving power from a driving source (driving motor) M1 is transmitted to the photosensitive drum 1, and the photosensitive drum 1 is driven to rotate in the direction of the arrow R1 in FIG. 1. The surface of the rotating photosensitive drum 1 is uniformly charged to a predetermined potential of normal polarity (in the first exemplary embodiment, negative polarity) by a charging roller 2, which is a roller-shaped charging member serving as a charging unit. The charging roller 2 is a conductive elastic roller, and includes a conductive elastic layer around a metal core. FIG. 2 illustrates a configuration layout diagram of the photosensitive drum 1 and the charging roller 2. As illustrated in FIG. 2, the charging roller 2 is arranged to contact the photosensitive drum 1. The driving force from the driving motor M1 is transmitted to the charging roller 2 by a charging roller (driving) gear 12, which is a driving force reception member for receiving a driving force from the driving source, and the charging roller 2 is driven to rotate in the direction of the arrow R2 in FIG. 1. In the configuration of the first exemplary embodiment, the driving force is transmitted from a gear portion 11*a* of a photosensitive drum flange 11 to the charging roller gear 12. A method for transmitting driving force between the photosensitive drum 1 and the charging roller 2 according to the first exemplary embodiment will be described with reference to FIG. 3. When driving is started, driving force is transmitted from the driving motor M1 serving as a main motor to a driving gear 14 located in the image forming apparatus 100. To transmit the driving force to the photosensitive drum 1, the driving force is transmitted from the driving gear 14 to a coupling member 13. If the photosensitive drum 1 is mounted on the image forming apparatus 100 and becomes ready to start an image forming operation, the coupling member 13 is engaged with the photosensitive drum flange 11 provided on the photosensitive drum 1, and the photosensitive drum 1 rotates. Since the gear portion 11*a* of the photosensitive drum flange 11 is engaged with the charging roller gear 12, the driving force from the driving motor M1 is also transmitted to the charging roller gear 12. In this way, the charging roller 2 is also driven to rotate at the same time. At this time, a predetermined charging voltage, which is a direct-current voltage of negative polarity, is applied to the charging roller 2 from a charging power supply E1 serving as a charging voltage application unit illustrated in FIG. 4. As illustrated in FIG. 1, the contact portion between the photosensitive drum 1 and the charging roller 2 is referred to as a charging portion a, where the surface of the photosensitive drum 1 is charged by the charging roller 2. The charging roller 2 charges the surface of the photosensitive drum 1 with a discharge occurring in at least one of the gaps formed between the charging roller 2 and an upstream area of the photosensitive drum 1 and downstream of the charging portion a in the rotation direction of the photosensitive drum 1.

A laser exposure unit 3 serving as an exposure unit (electrostatic latent image forming unit) scans and exposes the charged surface of the photosensitive drum 1 to a laser beam L modulated based on image data. The exposure unit 3 forms an electrostatic latent image on the photosensitive drum 1 by repeating the exposure to the laser beam L in a main scanning direction (rotation axis direction) of the photosensitive drum 1 while performing scans in a sub scanning direction (surface movement direction) as well. As illustrated in FIG. 1, the position at which the exposure unit 3 performs exposure on the photosensitive drum 1 is an image exposure portion b.

A developing unit 4 develops (visualizes) the electrostatic latent image formed on the photosensitive drum 1 into a toner image by using toner serving as a developer. The developing unit 4 includes a developing container 45 and a developing sleeve 41 serving as a developing member (developer bearing member) rotatably supported by the developing container 45. The developing container 45 contains black toner T that is a magnetic one-component developer serving as the developer. The toner T according to the first exemplary embodiment has a negative charging property. In other words, in the first exemplary embodiment, the normal polarity (charging polarity during development) of the toner T is negative polarity. The developing sleeve 41 is located in an opening formed in the developing container 45 at a position facing the photosensitive drum 1. The developing sleeve 41 is located so as to expose part of the developing sleeve 41 to the outside. The developing sleeve 41 includes a hollow nonmagnetic metal pipe typified by an aluminum pipe, and a conductive elastic rubber layer around the metal pipe. The conductive elastic rubber layer has a predetermined volume resistivity. A magnet roller 43 serving as a magnetic field generation unit is fixedly located inside the hollow portion of the developing sleeve 41.

The toner T contained in the developing container 45 is agitated by an agitation member 44 and supplied to the surface of the developing sleeve 41 by the magnetic attraction of the magnet roller 43. As the developing sleeve 41 rotates, the toner T supplied to the surface of the developing sleeve 41 passes through an opposing portion with a developing blade 42 serving as a developer regulation unit, whereby the toner T is formed into a uniform thin layer and charged to negative polarity by triboelectric charging. The toner T on the developing sleeve 41 is then conveyed by the rotation of the developing sleeve 41 to a developing position at which the toner T contacts the photosensitive drum 1. The toner T is transferred to the photosensitive drum 1 based on the electrostatic latent image on the photosensitive drum 1, and the electrostatic latent image on the photosensitive drum 1 is developed. At this time, a predetermined developing voltage, which is a direct-current voltage of negative polarity, is applied to the developing sleeve 41 from a developing power source E2 serving as a developing voltage application unit illustrated in FIG. 4. In the first exemplary embodiment, the toner image is formed by image part exposure and reversal development. More specifically, the surface of the photosensitive drum 1 is uniformly charged and then exposed to light. In this way, exposed areas (image areas) are formed where the surface potential has a smaller absolute value on the surface of the photosensitive drum 1. The toner T charged to the same polarity as that of the charging potential of the photosensitive drum 1 (in the first exemplary embodiment, negative polarity) adheres to the exposed areas (image areas).

As illustrated in FIG. 1, the position where the surface of the photosensitive drum 1 is opposed to and contacts the developing sleeve 41 is referred to as a developing portion c. In the first exemplary embodiment, the developing sleeve 41 is driven to rotate in the direction of the arrow R3 in FIG. 1 by the driving motor M1 so that the photosensitive drum 1 and the developing sleeve 41 move in the same direction at the developing portion c. While the above-described driving motor M1 is described to be used as a common driving source here, the image forming apparatus 100 may include other driving sources. In addition, the developing unit 4 makes a contact/separation operation, which is an operation for making contact with and separating from the photosensitive drum 1, in synchronization with the image forming operation of the developing unit 4. The contact/separation operation is performed by the action of a contact/separation cam 46, which is a developing contact/separation mechanism. The rotation of the contact/separation cam 46 moves the developing unit 4 between a contact position where the developing sleeve 41 contacts the photosensitive drum 1 and a separation position where the developing sleeve 41 is separated from the photosensitive drum 1 in synchronization with the image forming operation and a non-image forming operation.

The toner image formed on the photosensitive drum 1 is conveyed to a transfer portion d, which is a contact portion between the photosensitive drum 1 and a transfer roller 5 that is a roller-shaped transfer member serving as a transfer unit. A recording material P, such as a recording sheet, is conveyed from a storage unit 8 to the transfer portion d by a conveyance roller 9 in synchronization with the toner image on the photosensitive drum 1. At the transfer portion d, the toner image on the photosensitive drum 1 is transferred by the action of the transfer roller 5 to the recording material P sandwiched and conveyed between the photosensitive drum 1 and the transfer roller 5. At this time, a predetermined transfer voltage, which is a direct-current voltage of reverse polarity (in the first exemplary embodiment, positive polarity), to the normal polarity of the toner T is applied to the transfer roller 5 from a transfer power supply E3 serving as a transfer voltage application unit illustrated in FIG. 4. This forms an electric field between the transfer roller 5 and the photosensitive drum 1, and the toner image is electrostatically transferred from the photosensitive drum 1 to the recording material P.

The recording material P to which the toner image is transferred is conveyed to a fixing device 7 serving as a fixing unit. In the fixing device 7, heat and pressure are applied to the recording material P, whereby the toner image transferred to the recording material P is fixed to the recording material P.

The image forming apparatus 100 performs a series of image output operations (job) for forming an image on one or a plurality of recording materials P. The job is started by an instruction from an external apparatus (not-illustrated). A job typically includes an image forming step (printing step), a pre-rotation step, a sheet interval (recording material interval) step if images are formed on a plurality of recording materials P, and a post-rotation step. The image forming step refers to a period in which an electrostatic latent image is actually formed on the photosensitive drum 1, a toner image is formed by developing the electrostatic latent image, and the toner image is transferred and fixed. More specifically, the timing of the image forming processing differs depending on the positions where respective steps such as charging, exposure, development, transfer, and fixing are performed. The pre-rotation step refers to a period in which preparation operations prior to the image forming step are performed. The sheet interval step refers to a period corresponding to an interval between one recording material P and another recording material P in the transfer portion d while the image forming step is continuously performed on a plurality of recording materials P. In other words, the pre-rotation step refers to a period in which no recording material P is interposed in the contact portion (transfer portion d) between the photosensitive drum 1 and the transfer roller 5 during continuous printing. The post-rotation step refers to a period in which organizing operations (preparation operations) subsequent to the image forming step are performed. The image forming step is the image forming operation. The operation periods other than the image forming operation (pre-rotation step, sheet interval step, and post-rotation step) constitute the non-image forming operation. In the first exemplary embodiment, a cleaning operation (charged cleaning operation) for discharging toner adhering to the charging roller 2 onto photosensitive drum 1 is performed at a predetermined timing in the non-image forming operation.

Next, the components of the image forming apparatus 100 according to the first exemplary embodiment will be described in detail.

The photosensitive drum 1 includes a cylinder-shaped drum base and a photosensitive material thereon. The drum base is made of aluminum or nickel, and has an outer diameter of 24 mm Examples of the photosensitive material include organic photoconductors (OPCs), amorphous selenium, and amorphous silicon. The photosensitive drum 1 is rotatably supported by the image forming apparatus 100 and driven by the photosensitive drum flange 11 to rotate in the direction of the arrow R1 illustrated in FIG. 1 at a process speed of 150 mm/sec. In the present exemplary embodiment, the photosensitive material has a thickness of 15 μm.

The charging roller 2 is a single-layer roller including a conductive metal core and a conductive rubber layer, with an outer diameter of 7.5 mm and a volume resistivity of $10^3$ to $10^6$ Ω·cm. The conductive metal core is connected to the charging power supply E1 serving as a charging voltage unit that can apply a direct-current voltage (charging bias) of negative polarity. The charging roller 2 is driven by the charging roller gear 12 to rotate with a speed difference from the surface moving speed of the photosensitive drum 1. Driving the charging roller 2 can make charges uniform so that the toner adhering to the charging roller 2 is charged to the normal polarity, whereby image defects due to stains on the charging roller 2 can be prevented.

Figure 4:
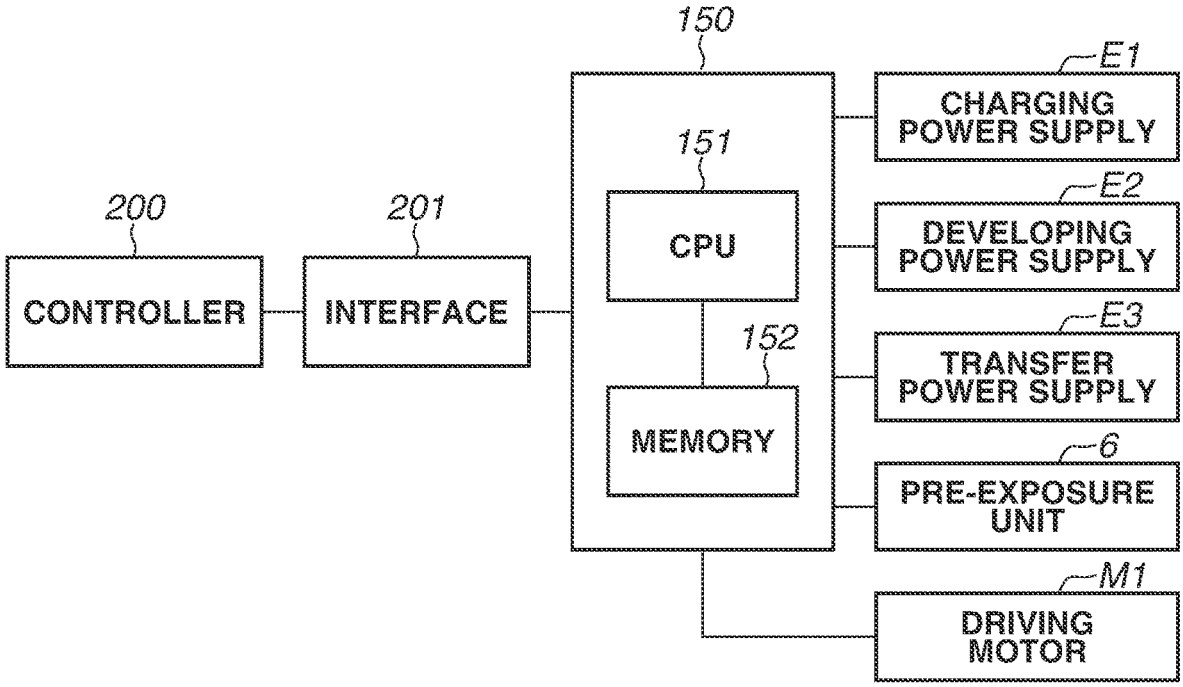
FIG. 4 is a block diagram schematically illustrating a control architecture of the image forming apparatus according to the first exemplary embodiment.

As illustrated in FIG. 4, a time-series electrical digital pixel signal of image information that is input from a controller 200 to a control unit 150 via an interface 201 and subjected to image processing is input to the laser exposure unit 3. The laser exposure unit 3 includes a laser output unit for outputting a laser beam L modulated based on the input time-series electrical digital pixel signal, a rotating polygonal mirror (polygon mirror), an f0 lens, and a reflecting mirror, and performs main-scanning exposure on the surface of the photosensitive drum 1 with the laser beam L. An electrostatic latent image corresponding to the image information is formed by the main-scanning exposure and sub scan exposure performed by rotation of the photosensitive drum 1.

The transfer roller 5 includes a conductive metal core and sponge-like conductive rubber. The sponge-like conductive rubber is made mainly of nitrile butadiene rubber (NBR) hydrin rubber (elastic member) and serves as a pressure contact portion against the photosensitive drum 1. The transfer roller 5 has an outer diameter of 12.5 mm and a hardness of 30° (Asker-C, 500 gf load).

2. Cleanerless System

The cleanerless system of the image forming apparatus 100 according to the first exemplary embodiment will now be described. Transfer residual toner remaining untransferred to the recording material P on the photosensitive drum 1 at the transfer portion d in FIG. 1 is subjected to a discharge caused by the electric field generated by the charging voltage in the gap formed immediately before the charging portion a and is thereby charged to the same negative polarity as that of the photosensitive drum 1. The transfer residual toner charged to the negative polarity does not adhere to the charging roller 2 and passes by the charging roller 2 at the charging portion a because of a potential relationship between the surface potential of the photosensitive drum 1 and the charging potential (the surface potential of the photosensitive drum 1=−700 V, the charging voltage=−1300 V). The transfer residual toner past the charging portion a is conveyed to the image exposure portion b by the rotation of the photosensitive drum 1. The amount of transfer residual toner is not so much as to block the laser beam L from the exposure unit 3, and thus does not affect the step of forming an electrostatic latent image on the photosensitive drum 1. Then, the transfer residual toner is conveyed to the developing portion c. The transfer residual toner conveyed to the developing portion c is transferred from non-image areas (unexposed areas) to the developing sleeve 41 by a potential difference between a dark area potential Vd (−700 V) on the surface of the photosensitive drum 1 and the developing voltage (−300 V), and collected into the developing unit 4. The toner collected into the developing unit 4 is mixed with the toner T in the developing unit 4 and used again.

The developing voltage according to the present exemplary embodiment is expressed in terms of a potential difference from the ground potential. Accordingly, the developing voltage of −300 V is interpreted as having a potential difference of −300 V from the ground potential (0 V) due to the developing voltage applied to the metal core of the developing sleeve 41. The same applies to the charging voltage and the transfer voltage.

Meanwhile, the transfer residual toner in the image areas (exposed areas) is not transferred to the developing sleeve 41 by a potential difference between a light area potential V1 (−100 V) on the surface of the photosensitive drum 1 and the developing voltage (−300 V), and remains on the photosensitive drum 1 as it is. Then, the transfer residual toner is conveyed to the transfer portion d together with the toner T electrostatically supplied onto the photosensitive drum 1 from the developing sleeve 41, and transferred to the recording material P as an image.

In such a manner, the image forming apparatus 100 performs development simultaneous cleaning for collecting the transfer residual toner into the developing unit 4 simultaneously with development. In other words, the developing unit 4 has both the functions of supplying the toner T in the developing unit 4 to the image areas on the photosensitive drum 1 and collecting the transfer residual toner remaining on the photosensitive drum 1 in the developing portion c.

To make the transfer residual toner pass without adhering to the charging roller 2, the image forming apparatus 100 according to the first exemplary embodiment employs the following two configurations.

As a first configuration, as illustrated in FIG. 1, a pre-exposure unit 6 serving as a discharging unit for discharging the photosensitive drum 1 is arranged downstream of the transfer portion d and upstream of the charging portion a in the rotation direction of the photosensitive drum 1. The pre-exposure unit 6 optically discharges the surface of the photosensitive drum 1 before the entry to the charging portion a, to produce a stable discharge at the charging portion a. The exposure position of the pre-exposure unit 6 downstream of the transfer portion d and upstream of the charging portion a in the rotation direction of the photosensitive drum 1 is referred to as a discharging portion e. The transfer residual toner on the photosensitive drum 1 can be charged to the normal polarity again by optically discharging the post-transfer photosensitive drum 1 by the pre-exposure unit 6 to produce a uniform discharge during the charging processing.

As a second configuration, the charging roller 2 according to the first exemplary embodiment is rotated with a peripheral speed difference so that the charging roller 2 has a surface moving speed 1.1 times that of the photosensitive drum 1. This surface moving speed difference (peripheral speed difference) causes the positively-charged transfer residual toner adhering to the charging roller 2 to slide at the charging portion a and be reversed into negative polarity, whereby the transfer residual toner is prevented from being accumulated on the charging roller 2. By such two configurations, the transfer residual toner is prevented from adhering to the charging roller 2. In the first exemplary embodiment, the charging roller gear 12 serving as a driving force reception member is provided at one longitudinal end of the charging roller 2. The charging roller gear 12 is in engagement with the gear portion 11a of the photosensitive drum flange 11 provided at the same longitudinal end of the photosensitive drum 1. Accordingly, as the photosensitive drum 1 is driven to rotate, the charging roller 2 is also driven to rotate. The second configuration is not limited to that of the first exemplary embodiment, and any configuration that can provide a peripheral speed difference between the photosensitive drum 1 and the charging roller 2 may be used. For example, the image forming apparatus 100 may include independent driving sources (driving motors) for rotating the photosensitive drum 1 and the charging roller 2, and the driving force from the respective driving sources may be input to the photosensitive drum 1 and the charging roller 2 for rotation.

3. Control Architecture

Next, a control architecture according to the first exemplary embodiment will be described.

The control unit 150 is a unit for controlling operation of the image forming apparatus 100, and transmits and receives various electrical information signals. The control unit 150 also processes electrical information signals input from various process devices and sensors, and processes command signals for various process devices. FIG. 4 is a block diagram schematically illustrating a control architecture of the image forming apparatus 100 according to the first exemplary embodiment. The controller 200 exchanges various types of electrical information with a host apparatus, and controls the image forming operation of the image forming apparatus 100 in a centralized manner by using the control unit 150 via the interface 201 based on predetermined control programs and reference tables.

The control unit 150 serving as a control unit of the image forming apparatus 100 includes a central processing unit (CPU) 151, which is a central element for performing arithmetic processing, and a memory 152 including storage elements such as a read-only memory (ROM) and a random access memory (RAM). The RAM stores detection results of the sensor and calculation results. The ROM stores control programs and data tables determined in advance. The control unit 150 controls the operation of the image forming apparatus 100 in a centralized manner, controls transmission and reception of various electrical information signals and drive timing, and performs predetermined image formation sequence control. Control targets of the image forming apparatus 100 are connected to the control unit 150. For example, the charging power supply E1, the developing power source E2, the transfer power supply E3, the pre-exposure unit 6, and the driving motor M1 are connected to the control unit 150. In particular, in the first exemplary embodiment, the control unit 150 performs a charging cleaning operation to be described below by controlling on/off and controlling the output values of the various power supplies E1, E2, and E3, controlling on/off the irradiation with the discharging light by the pre-exposure unit 6, and controlling on/off of the driving motor M1.

The image forming apparatus 100 forms an image on a recording material P based on an electrical image signal input from the host apparatus to the controller 200. Examples of the host apparatus include an image reader, a personal computer, a facsimile machine, and a smartphone.

4. Injection Charging

Next, injection charging will be described. In the following description, for the sake of convenience, a relationship in magnitude between voltage values, current values, or potentials will be described in terms of absolute values thereof.

Injection charging refers to a phenomenon in which a potential is formed on the surface of the photosensitive drum 1 when the photosensitive drum 1 and a voltage-applied member such as the charging roller 2 rotate in contact with each other. Movement of charges from the member to the photosensitive drum 1 causes a current to flow and a potential is formed on the surface of the photosensitive drum 1, aside from the formation of a potential by a discharge occurring in the gap between the photosensitive drum 1 and the member. Examples of the case where injection charging occurs include a case where the charging roller 2, which is a voltage-applied member, and the photosensitive drum 1 rotate in contact with each other at respective different surface moving speeds as in the first exemplary embodiment, and a case where the photosensitive drum 1 has a low surface resistance.

In the first exemplary embodiment, the ratio of the surface moving speed of the charging roller 2 to that of the photosensitive drum 1 (peripheral speed ratio) is 110%. In this way, the surface of the photosensitive drum 1 and the surface of the charging roller 2 thus slide during rotation. Controlling the ratio of the surface moving speed of the charging roller 2 to that of the photosensitive drum 1 to 105% or more and 120% or less can desirably prevent adhesion of toner charged to reverse polarity and prevent injection charging into the surface of the photosensitive drum 1.

Figure 5:
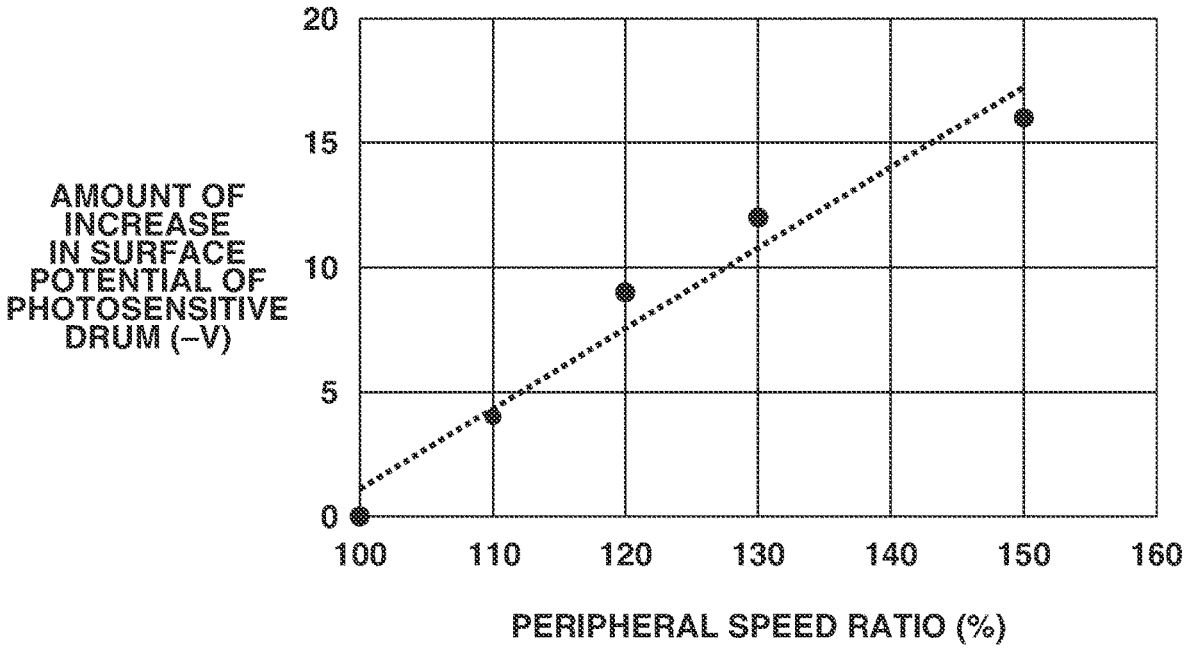
FIG. 5 is a graph illustrating an amount of injection charging to the photosensitive drum according to the first exemplary embodiment.

The effect of the surface frictional sliding on the formation of the potential on the photosensitive drum 1 will be described with reference to FIG. 5. FIG. 5 is a graph illustrating amounts of increase in the surface potential of the photosensitive drum 1 when the photosensitive drum 1 and the charging roller 2 are rotated at different peripheral speed ratios with a charging voltage of −100 V applied to the charging roller 2 and with a surface potential of 0 V on the photosensitive drum 1. As can be seen from FIG. 5, the higher the peripheral speed ratio between the photosensitive drum 1 and the charging roller 2 is, the greater the amount of increase is in the surface potential of the photosensitive drum 1. The surface potential of the photosensitive drum 1 increases because of the movement of charges from the charging roller 2. Thus, the higher the peripheral speed ratio, the greater the substantial contact area between the surface of the photosensitive drum 1 and the surface of the charging roller 2, and thus, the greater the chance for charges to move from the charging roller 2 to the surface of the photosensitive drum 1. As a result, the amount of increase in the surface potential of the photosensitive drum 1 has dependency on the peripheral speed ratio. The higher the peripheral speed ratio is, the more the surface potential increases.

Figure 6:
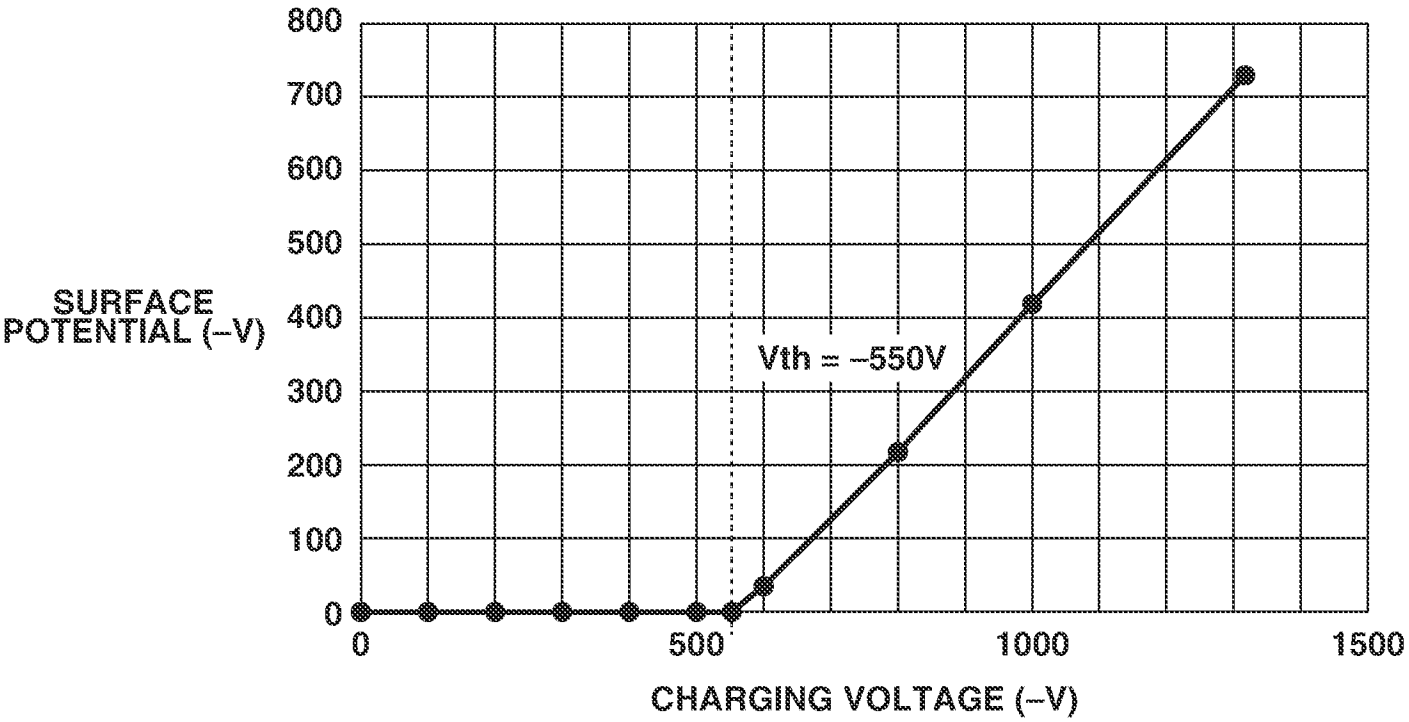
FIG. 6 is a graph illustrating a relationship between a charging voltage and a surface potential of the photosensitive drum according to the first exemplary embodiment.
Figure 7:
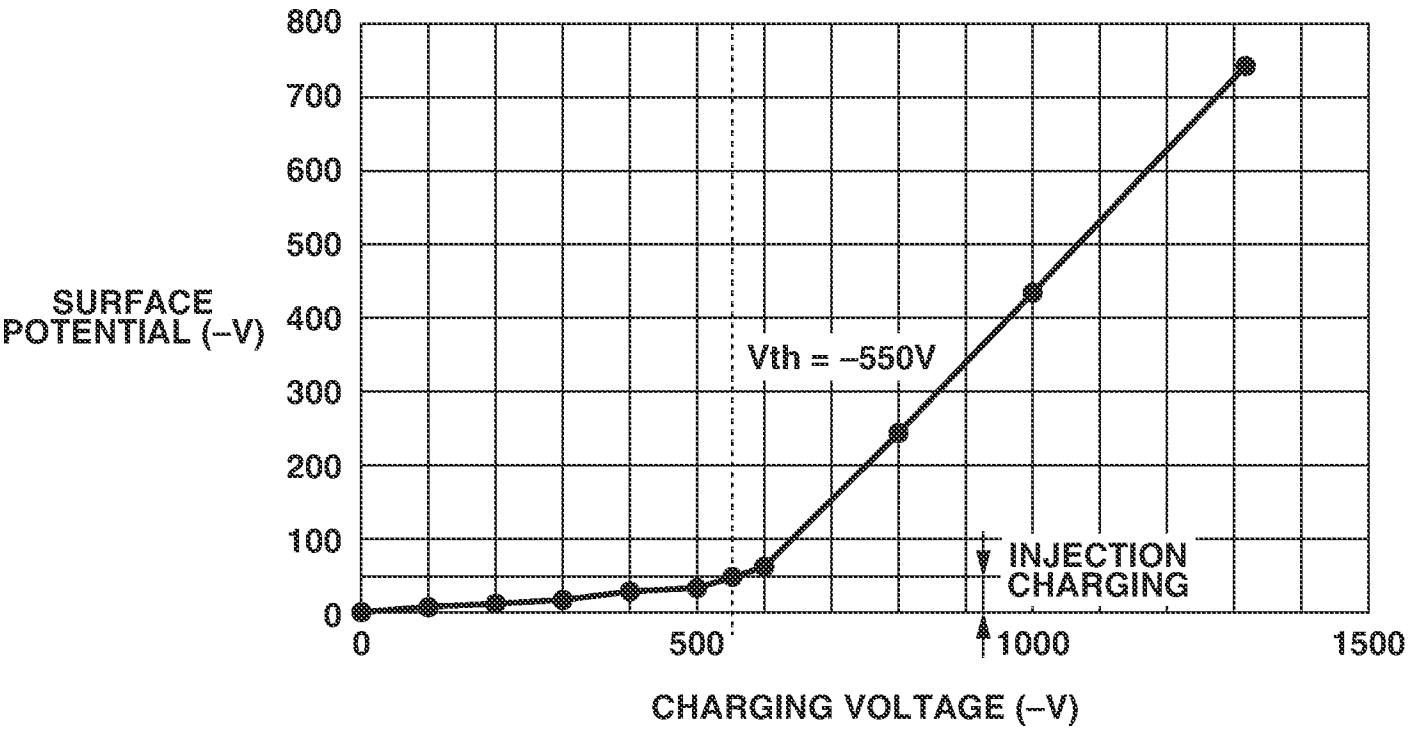
FIG. 7 is a graph illustrating a relationship between the charging voltage and the surface potential of the photosensitive drum according to the first exemplary embodiment.

FIGS. 6 and 7 are graphs illustrating measurement results of the relationship between the charging voltage applied to the charging roller 2 and the surface potential of the photosensitive drum 1 in a high-temperature high-humidity (H/H) environment (temperature of 30° C. and relative humidity of 80%). FIG. 6 illustrates measurement results of a case where the peripheral speed ratio between the photosensitive drum 1 and the charging roller 2 is 100% and the charging roller 2 follows the photosensitive drum 1. FIG. 7 illustrates measurement results in the configuration of the first exemplary embodiment in which the peripheral speed ratio between the photosensitive drum 1 and the charging roller 2 is 110%. The H/H environment lowers the surface resistance of the photosensitive drum 1 and facilitates the occurrence of injection charging.

In FIG. 6, as the direct-current voltage applied to the charging roller 2 increases, the surface potential of the photosensitive drum 1 remains unchanged up to a certain voltage value. The surface potential of the photosensitive drum 1 then starts to increase at the certain voltage. The value of the direct-current voltage at which the surface potential of the photosensitive drum 1 starts to increase is referred to as a discharge start voltage Vth. For example, in the first exemplary embodiment, the discharge start voltage Vth is −550 V. The discharge start voltage Vth is determined by the gap between the charging roller 2 and the photosensitive drum 1, the thickness of the photosensitive layer of the photosensitive drum 1, and the relative permittivity of the photosensitive layer of the photosensitive drum 1. If a direct-current voltage higher than or equal to the discharge start voltage Vth is applied to the charging roller 2, a discharge phenomenon occurs in the gap between the charging roller 2 and the photosensitive drum 1 according to Paschen's law. Charges appear on the surface of the photosensitive drum 1 to form a surface potential. In other words, if a direct-current voltage higher than or equal to the discharge start voltage Vth is applied to the charging roller 2, the surface potential of the photosensitive drum 1 starts to increase. Then, the surface potential of the photosensitive drum 1 increases in a linear relationship with the direct-current voltage applied to the charging roller 2 at a gradient of approximately 1. To obtain the surface potential (dark area potential) Vd of the photosensitive drum 1 desirable for electrophotography, a direct-current voltage of (Vd+Vth) is to be desirably applied to the charging roller 2. The application of the direct-current voltage (Vd+Vth) to the charging roller 2 produces a discharge between the photosensitive drum 1 and the charging roller 2, whereby a surface potential as much as the direct-current voltage Vd is formed on the surface of the photosensitive drum 1.

On the other hand, in FIG. 7, the rotation at the peripheral speed ratio of 110% makes the surface potential of the photosensitive drum 1 start to increase even when the direct-current voltage applied to the charging roller 2 is lower than the discharge start voltage Vth. The application of the discharge start voltage Vth to the charging roller 2 produces a surface voltage of approximately −50 V on the photosensitive drum 1. The reason is that the frictional sliding moves charges to cause injection charging in addition to a drop in the electrical resistance on the surface of the photosensitive drum 1 in the H/H environment. In such a manner, a small surface potential can be formed on the surface of the photosensitive drum 1 even if a direct-current voltage lower than the discharge start voltage Vth according to Paschen's law is applied.

Conditions for lowering surface resistance of the photosensitive drum 1 aside from the above-described condition include a case where discharge products adhere to the surface of the photosensitive drum 1 and a case where an external additive or foreign substance having low resistance adheres. Discharge products are substances generated caused by the generation of ozone and/or NOx through reaction attributable to a discharge occurring in the gap at the charging portion a where the photosensitive drum 1 makes contact with the charging roller 2. The discharge products absorb moisture on the surface of the photosensitive drum 1 and tend to lower the resistance in an environment in which the absolute moisture content in the air is high like the H/H environment. The adhesion of the discharge products to the photosensitive drum 1 causes injection charging even in a follower configuration in which there is no difference in the surface moving speed between the charging roller 2 and the photosensitive drum 1. The configuration of the first exemplary embodiment may be applied to the above-described case where substances such as discharge products adhere.

5. Charged Cleaning Operation

In the first exemplary embodiment, if a detection unit serving as a not-illustrated environmental sensor of the image forming apparatus 100 detects a temperature of 27° C. or higher and a humidity of 70% or higher, the environment is determined to be an H/H environment, and variable voltage control is performed in a charged cleaning operation during the non-image forming operation. The determination criteria for the H/H environment can be changed as appropriate depending on the materials of the photosensitive drum 1 and the charging roller 2. The absolute moisture content in the air, calculated from the temperature and humidity detected by the environment sensor, may desirably be 15.0 $g/m^3$.

Figure 8:
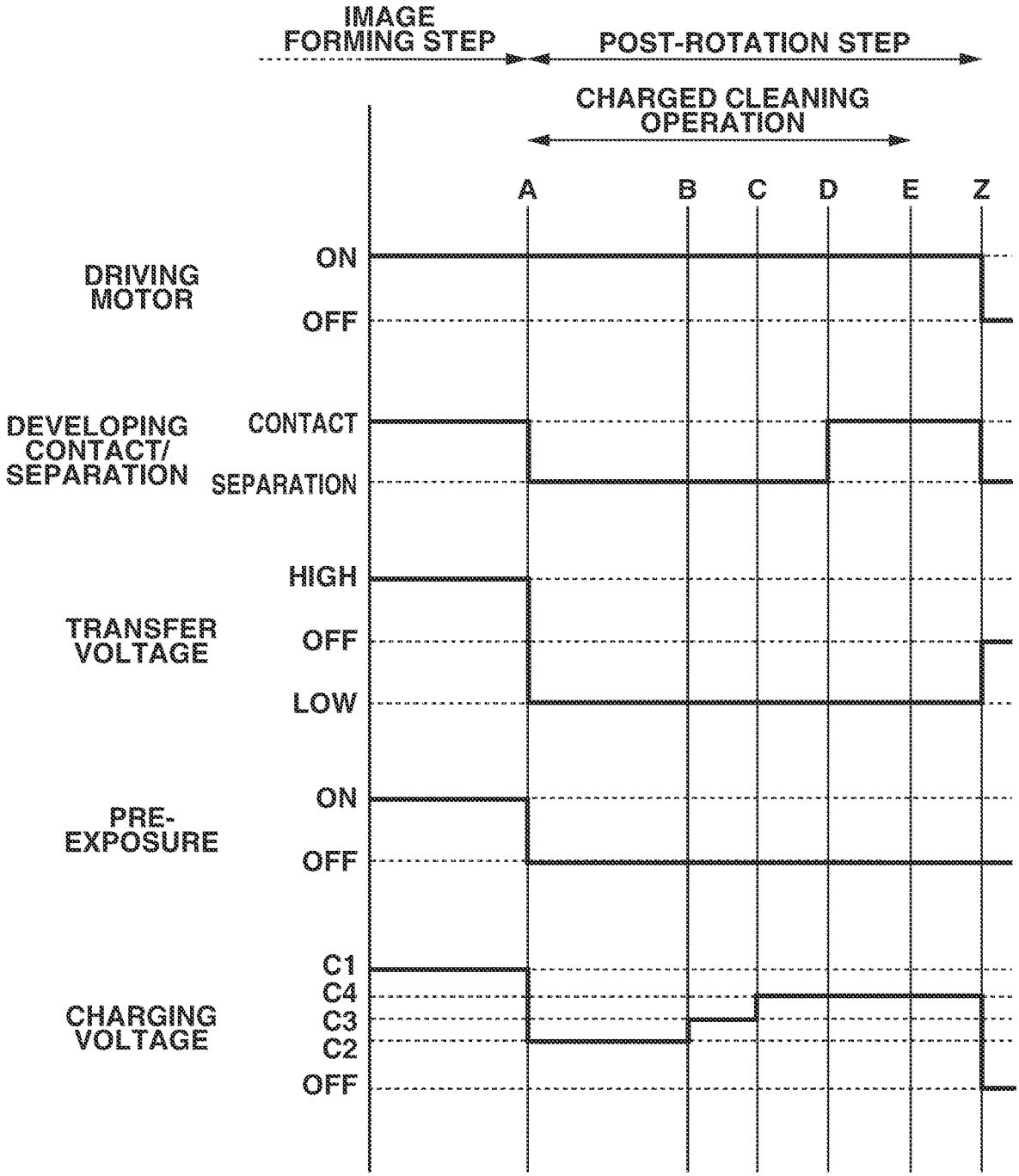
FIG. 8 is a timing chart of a charged cleaning operation according to the first exemplary embodiment.

FIG. 8 is a timing chart of the charged cleaning operation according to the first exemplary embodiment in the H/H environment. In the charged cleaning operation, the control unit 150 controls the operation of various components with the timing illustrated in FIG. 8. In the first exemplary embodiment, the charged cleaning operation is performed as a cleaning operation in the post-rotation step each time the number of output images reaches or exceeds a predetermined threshold. Details of the charged cleaning operation will be described below.

The post-rotation step starts at a timing A when the image forming step ends and the recording material P exits the transfer portion d. At this timing A, the control unit 150 rotates the contact/separation cam 46 of the developing unit 4 to separate the developing sleeve 41 from the photosensitive drum 1. The reason is to reduce fog toner transferred from the developing sleeve 41 to the photosensitive drum 1 for sufficient charged cleaning. The fog toner refers collectively to toner adhering to the non-image forming parts of the photosensitive drum 1. The amount of fog toner adhering thereto is determined by the magnitude of back contrast (Vback), which is a potential difference between the dark area potential Vd of the photosensitive drum 1 and the developing voltage applied to the developing sleeve 41. At the timing A, the transfer voltage applied to the transfer roller 5 is switched from HIGH (+1000 V) to LOW (−1000 V). Switching the transfer voltage to LOW (−1000 V) brings the transfer roller 5 to the negative polarity side of the dark area potential Vd (−700 V) of the photosensitive drum 1, whereby positive charges are prevented from flowing from the transfer roller 5 into the photosensitive drum 1. This eliminates a flow of positive charges into the toner T on the photosensitive drum 1, whereby the toner T on the photosensitive drum 1 is prevented from being turned into positive polarity by the transfer voltage. In the first exemplary embodiment, the transfer roller 5 is configured to follow the rotation of the photosensitive drum 1. If the transfer roller 5 is configured to be actively driven, the transfer voltage may be controlled to also prevent formation of a surface potential by injection charging due to the current flow from the transfer roller 5 into the photosensitive drum 1. More specifically, the transfer voltage LOW may be set to −700 V, i.e., substantially the same potential as the surface potential of the photosensitive drum 1. At the timing A, the charging voltage applied to the charging roller 2 is switched from a charging voltage C1 during image formation (−1300 V) to a charging voltage C2 for charged cleaning (−800 V). The timing at which the charging voltage is switched to the charging voltage C2 for charged cleaning is set to the start timing of the charged cleaning operation. At the same timing A, the pre-exposure unit 6 is turned off. This eliminates a discharge from the charging roller 2 without reducing the absolute value of the surface potential of the photosensitive drum 1, whereby the toner on the charging roller 2 is prevented from being turned into positive polarity.

The toner is prevented from being turned into positive polarity at the transfer roller 5 and the charging roller 2, and the toner is charged to negative polarity, which is the normal polarity, by the frictional sliding between the photosensitive drum 1 and the charging roller 2. The toner charged to the normal polarity is then transferred to the photosensitive drum 1 by a potential difference A between the surface potential (−700 V) of the photosensitive drum 1 and the charging voltage C2 (−800 V). However, if the charging voltage continues to be applied in the H/H environment with the pre-exposure unit 6 off, the surface potential of the photosensitive drum 1 increases due to injection charging from the charging voltage, and the surface potential of the photosensitive drum 1 approaches the charging voltage C2.

At a timing B when the photosensitive drum 1 has rotated by approximately two rotations since the timing A of switching the charging voltage to the charging voltage C2 (−800 V), the charging voltage is thus switched from the charging voltage C2 (−800 V) at the start of the charged cleaning operation to a charging voltage C3 (−850 V). The reason is to maintain the surface potential of the charging roller 2 negatively higher than the surface potential of the photosensitive drum 1. The timing B to switch the charging voltage is not limited to the above-described timing as long as the surface potential of the charging roller 2 can be maintained negatively higher than that of the photosensitive drum 1. For that purpose, the change amount of the charging voltage is not limited to 50 V, either, and may be modified based on the amount of change in the surface potential of the photosensitive drum 1.

At timing C when the photosensitive drum 1 has rotated by approximately one turn from the timing B of switching the charging voltage to the charging voltage C3 (−850 V), the charging voltage is switched from the charging voltage C3 (−850 V) to a charging voltage C4 (−900 V). The reason is also to make the surface potential of the charging roller 2 negatively higher than that of the photosensitive drum 1. In other words, a charging voltage of even greater absolute value may be required when the surface of the photosensitive drum 1 at the position of the charging portion a subjected to the charging voltage C3 (−850 V) has made a turn by the rotation of photosensitive drum 1. The timing C is thus not limited to the above-described timing as long as the surface potential of the charging roller 2 can be maintained negatively higher than the surface potential of the photosensitive drum 1. For that purpose, the change amount of the charging voltage is not limited to 50 V and may be modified based on the amount of change in the surface potential of the photosensitive drum 1.

Next, at a timing D when the photosensitive drum 1 has rotated by one turn from the timing C of switching the charging voltage to the charging voltage C4 (−900 V), the developing sleeve 41 is brought into contact with the photosensitive drum 1 again. With this operation, the toner charged to the negative polarity, which is the normal polarity on the photosensitive drum 1, is thereby transferred to the developing sleeve 41 at the developing portion c by a potential difference between the surface potential of the photosensitive drum 1 and the developing voltage, whereby the toner is collected into the developing unit 4. Since the toner of the negative polarity, which is the normal polarity, lies over the entire periphery of the photosensitive drum 1, a developing and collection time at least as much as or more than one rotation of the photosensitive drum 1 may be desirable.

In the first exemplary embodiment, the charged cleaning operation ends at a timing E at which the photosensitive drum 1 has rotated by one turn after the charging voltage is switched to the charging voltage C4 and the developing sleeve 41 is brought into contact with the photosensitive drum 1. In other words, a charged cleaning operation period is from the timing A to the timing E illustrated in FIG. 8. In the first exemplary embodiment, the duration of the charged cleaning is 2.0 sec. This duration (charged cleaning time) is equivalent to approximately 12 rotations of the charging roller 2. The toner T on the charging roller 2 is sufficiently charged to the negative polarity by such frictional sliding, and transferred to the photosensitive drum 1. The charged cleaning time can be changed as appropriate depending on the surface moving speed difference between the charging roller 2 and the photosensitive drum 1 and the state of the adhering toner.

After the timing E when the charged cleaning operation ends, the operation for separating the developing sleeve 41 is performed and various voltages and the driving motor M1 are controlled to be off at a timing Z. Then, a series of image output operations ends.

In the first exemplary embodiment, the charging voltage C2 for charged cleaning is set at −800 V to provide a potential difference A of 100 V from the dark area potential Vd (−700 V) of the photosensitive drum 1. However, it is not limited thereto, and the potential difference A may be greater. The greater the potential difference A, the higher the cleaning performance in the first rotation of the photosensitive drum 1. However, since the amount of injection charging acting on the photosensitive drum 1 increases with the potential difference A being greater, the charging voltages C3 and C4 are also set to be greater in magnitude. Accordingly, as the number of rotations of the photosensitive drum 1 becomes greater, the absolute values of the charging voltages needs to be greater than in the first exemplary embodiment.

6. Effects of Charging Voltage Control due to Effect of Injection Charging in Charged Cleaning Operation The effects of a charging voltage control performed during the charged cleaning operation were examined by experiment. Image formation was started with a charging voltage of −1300 V, and image defects when an image having a printing ratio of 10% was printed on 5000 sheets by two-sheet intermittent operations were observed.

In the first exemplary embodiment, correction control illustrated in FIG. 8 was performed on the charging voltage during the charged cleaning operation executed in each intermittent operation. By contrast, in a first comparative example, the charged cleaning operation was performed with the same charging voltage as that during image formation, without correcting the charging voltage. Table 1 illustrates the results of image defects observed at respective numbers of images formed.

TABLE 1

| Number of formed images (sheets) | 1000 | 3000 | 5000 |
|---|---|---|---|
| First comparative example | ○ | x | x |
| First exemplary embodiment | ○ | ○ | ○ |

In Table 1, the mark 0 represents a state where no image defect occurred on the recording material P. The mark x represents a state where an image defect such as fog toner, streaks, and dots was visually observed on the recording material P.

In the first comparative example, an image defect occurred when 3000 images were formed. The reason is considered to be that the execution of the charged cleaning operation without correcting the charging voltage during the charged cleaning operation interfered with sufficient transfer of the toner charged to the normal polarity from the charging roller 2 to the photosensitive drum 1. In other words, the absolute value of the surface potential of the photosensitive drum 1 was increased by injection charging, and the potential difference A between the charging roller 2 and the surface potential of the photosensitive drum 1 decreased.

By contrast, in the first exemplary embodiment, image defects remained in a visually unnoticeable level. The reason is considered to be that potential increase as much as injected potentials due to frictional sliding was successfully cancelled by performing the charging voltage control based on the rotation of the photosensitive drum 1 during the charged cleaning operation to change the value of the charging voltage at an appropriate timing. By performing such an operation, the potential difference A between the surface potential of the photosensitive drum 1 and the charging roller 2 was successfully maintained during the charged cleaning operation.

The image forming apparatus 100 used in the first exemplary embodiment, that causes injection charging of injecting charge from the charging roller 2 to the photosensitive drum 1, has the following characteristics. The control unit 150 controls execution of the image forming operation for forming a toner image on a recording material P and the charged cleaning operation for cleaning the charging roller 2 by transferring the toner adhering to the charging roller 2 to the photosensitive drum 1 and collecting the transferred toner by the developing sleeve 41. In the charged cleaning operation, to form a potential difference A in a direction in which electrostatic force directed from the charging roller 2 to the photosensitive drum 1 acts on the toner charged to the normal polarity, the control unit 150 controls the first charging voltage applied to the charging roller 2 in the following manner After the application of the first charging voltage, the control unit 150 switches the charging voltage so as to apply the second charging voltage having an absolute value greater than that of the first charging voltage to the charging roller 2. Such a control can provide the above-described effect.

As described above, according to the first exemplary embodiment, the charging voltage is switched to increase negatively stepwise during the period of the charged cleaning operation in the post-rotation step. Increasing the charging voltage stepwise at a timing corresponding to each rotation of the photosensitive drum 1 makes the charging voltage high with respect to the charge-injected photosensitive drum 1. In this way, the surface potential of the charging roller 2 can be maintained negatively higher than the surface potential of the photosensitive drum 1, whereby an electric field desirable to transfer the toner of negative polarity to the photosensitive drum 1 can be obtained. This can suppress toner accumulation on the charging roller 2 and provide a favorable image without image defects such as streaks and dots.

In the first exemplary embodiment, both the timing to start the separation operation of the developing sleeve 41 and the timing to switch the charging voltage and the transfer voltage are the same timing A. However, this is not limited thereto. For example, the charging voltage may be applied to the charging portion a by the time when the developing sleeve 41 is completely separated from the photosensitive drum 1. The charging voltage may be switched after the toner discharged from the transfer roller 5 prior to the switching the transfer voltage to LOW passes the discharge portion a.

The pre-exposure unit 6 according to the first exemplary embodiment is configured to directly irradiate the discharging portion e of the photosensitive drum 1 with light. However, it is not limited thereto. For example, to discharge the surface of the photosensitive drum 1, the tips of a brush member made of conductive fibers, such as a fur brush, may be brought into contact with the photosensitive drum 1. If a light guide having an irradiation angle is used, the timing to turn on/off the pre-exposure unit 6 may be changed as appropriate.

The charging member according to the first exemplary embodiment is described to be a roller-shaped member. However, it is not limited thereto. For example, a charging member of endless belt shape wound around a plurality of support rollers may be used. Rotating members of other forms may also be suitably used. For example, one of a plurality of support rollers may be brought into contact with the photosensitive drum 1 via a belt.

The charged cleaning operation according to the first exemplary embodiment is described to be performed in the post-rotation step during the non-image forming operation. However, it is not limited thereto, and the charged cleaning operation may be performed at any timing during the non-image forming operation. For example, if the number of output images reaches or exceeds a predetermined threshold in executing a job in the printing step, the charged cleaning operation can be performed by extending the sheet interval. While the charged cleaning operation according to the first exemplary embodiment is limited to the case where the H/H environment is detected by the detection unit serving as the environmental sensor, the charged cleaning operation can also be applied to other environments.

Figure 9:
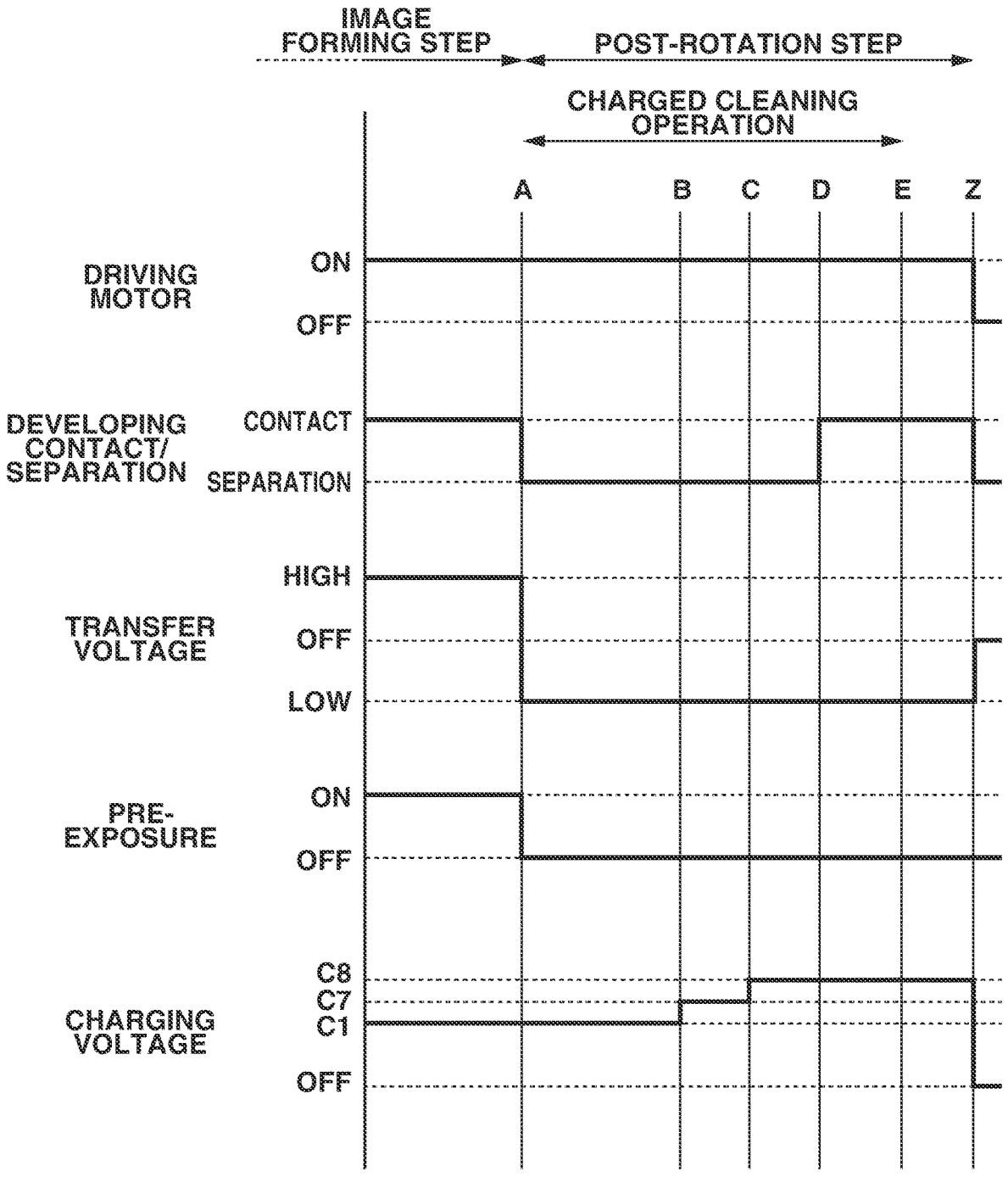
FIG. 9 is a timing chart of another charged cleaning operation according to the first exemplary embodiment.

As illustrated in FIG. 9, the charging voltage at the start of the post-rotation step in which the charged cleaning operation is performed may be controlled to increase simply stepwise without being changed from the image forming step, which is the image forming operation. More specifically, the charging voltage may be controlled to change from the charging voltage C1 to a charging voltage C7 and to a charging voltage C8. In such a case, to stabilize the back contract (Vback), which is the potential difference between the surface potential of the photosensitive drum 1 and the developing voltage during development and collection, either the surface potential of the photosensitive drum 1 is controlled to decrease in absolute value or the developing voltage is controlled to increase in absolute value.

Figure 10:
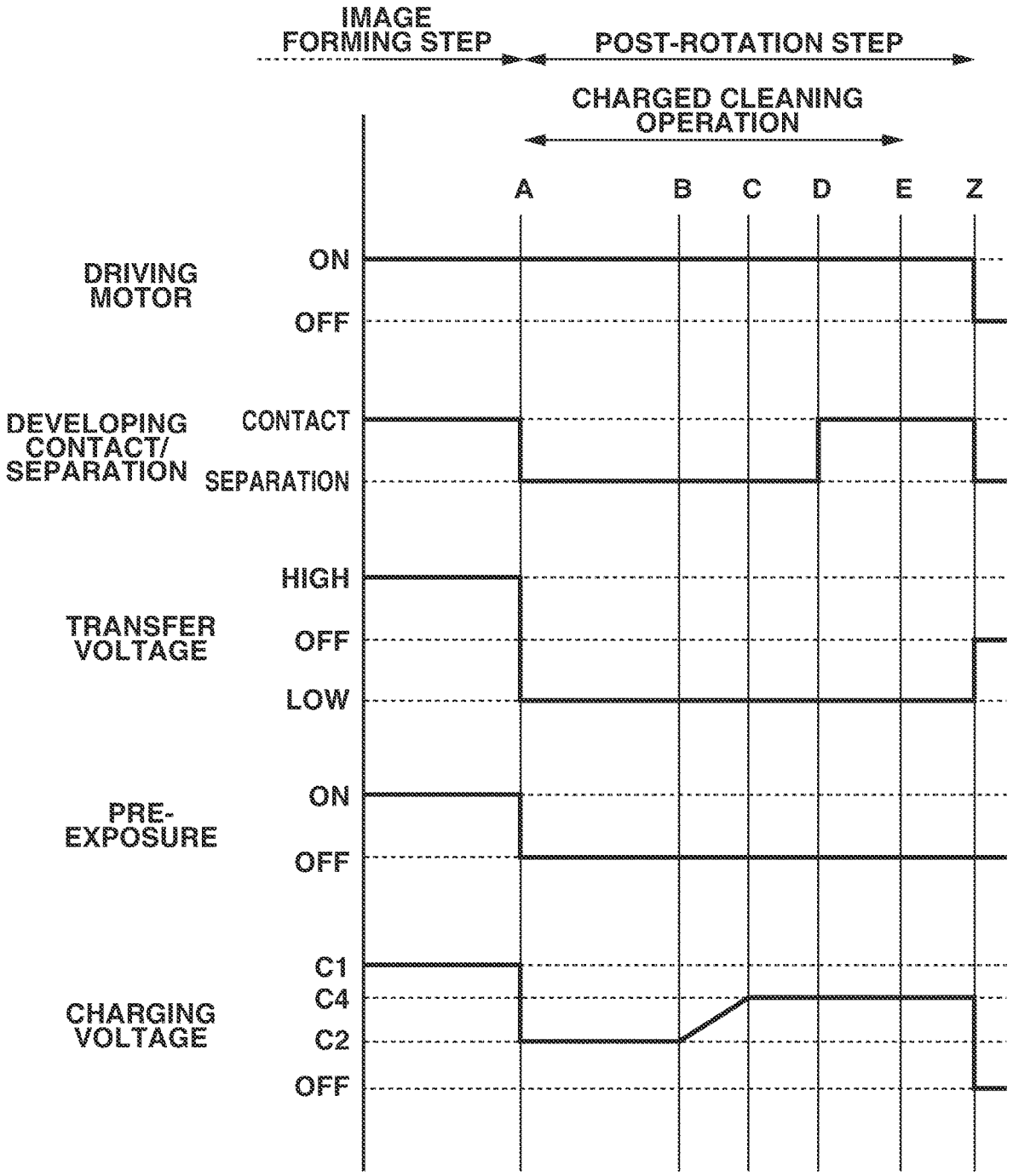
FIG. 10 is a timing chart of another charged cleaning operation according to the first exemplary embodiment.

As illustrated in FIG. 10, the charging voltage may be controlled to change linearly from the charging voltage C2 for charged cleaning to the charging voltage C4.

In the first exemplary embodiment, the toner of magnetic one-component developer is used as the developer. However, nonmagnetic one-component developer may be used.

In the first exemplary embodiment, the image forming apparatus 100 having a single cartridge structure including a single photosensitive drum 1, charging roller 2, and developing unit 4 is used. However, the first exemplary embodiment may be applied to an image forming apparatus including a plurality of cartridge structures. For example, an intermediate transfer method in which toner images are transferred from the photosensitive drums 1 to an intermediate transfer belt serving as an intermediate transfer member and then transferred to a recording material may be used.

A first modification will now be described. In the configuration of an image forming apparatus 100 applied to the first modification, similar members to those of the first exemplary embodiment are designated by the same reference numerals, and a description thereof will be omitted.

Figure 11:
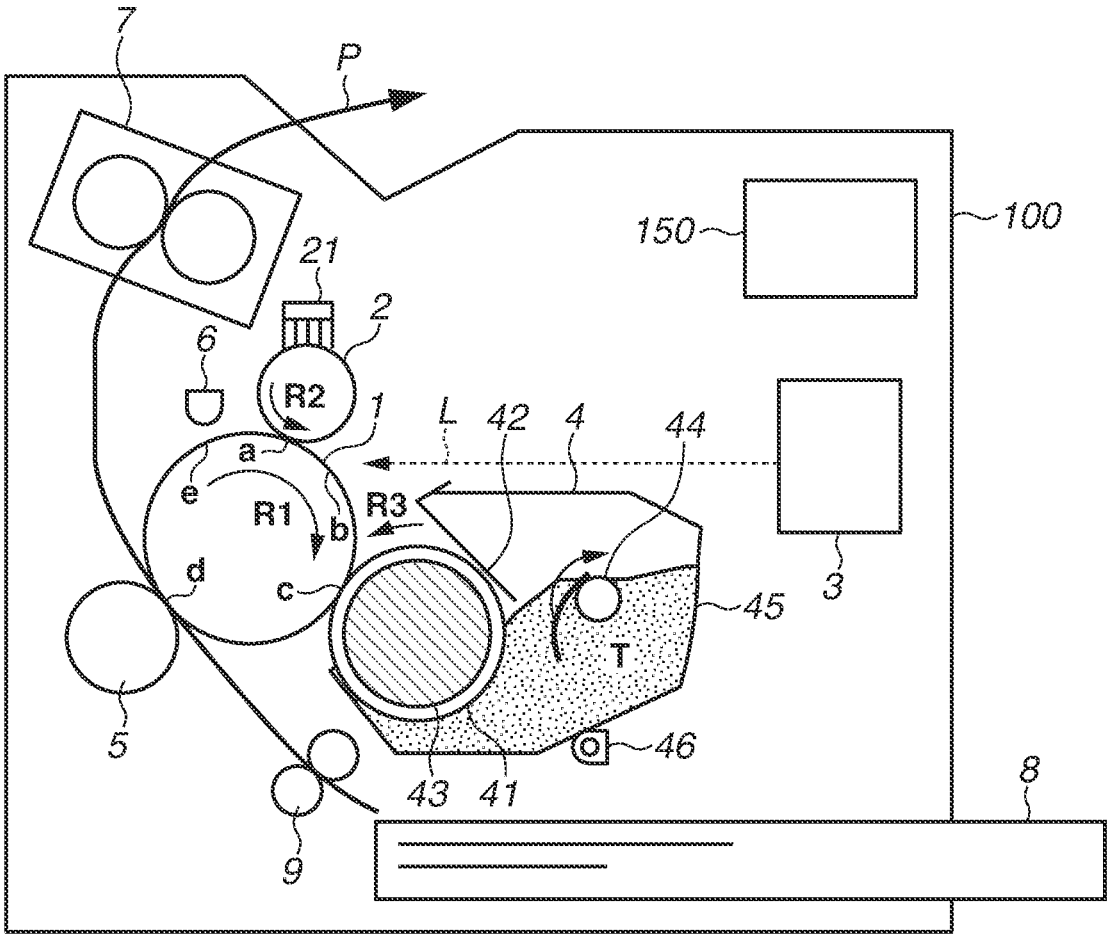
FIG. 11 is a diagram illustrating an image forming apparatus according to a first modification.

The first modification is characterized in that the image forming apparatus 100 having a similar configuration to that of the first exemplary embodiment includes a charging roller brush 21 serving as a cleaning member for the charging roller 2. FIG. 11 is a schematic configuration diagram of the image forming apparatus 100 according to the first modification. The charging roller brush 21 is provided so as to apply a predetermined pressure to the charging roller 2. The charging roller brush 21 has conductivity. A voltage having the same potential as that of the charging roller 2 is applied to the charging roller brush 21, whereby the toner on the charging roller 2 is charged to the negative polarity by triboelectric charging. When the toner of negative polarity on the charging roller 2 reaches the charging portion a, which is the contact portion with the photosensitive drum 1, the toner of negative polarity is electrostatically transferred to the photosensitive drum 1. The charging roller 2 can thereby be cleaned. In view of the cleaning performance of the charging roller 2, a potential difference may be provided between the charging roller brush 21 and the charging roller 2.

In the image forming apparatus 100 including the above-described charging roller brush 21, toner accumulates on the charging roller brush 21, for example, during continuous image formation. The toner accumulation on the charging roller brush 21 lowers the cleaning performance of the charging roller 2, and the increased amount of toner adhering to the charging roller 2 causes an image defect due to degraded charging performance In the charged cleaning operation according to the first modification, a time period for discharging the toner accumulated on the charging roller brush 21 to the charging roller 2 may therefore be desirable.

1. Charged Cleaning Operation

Figure 12:
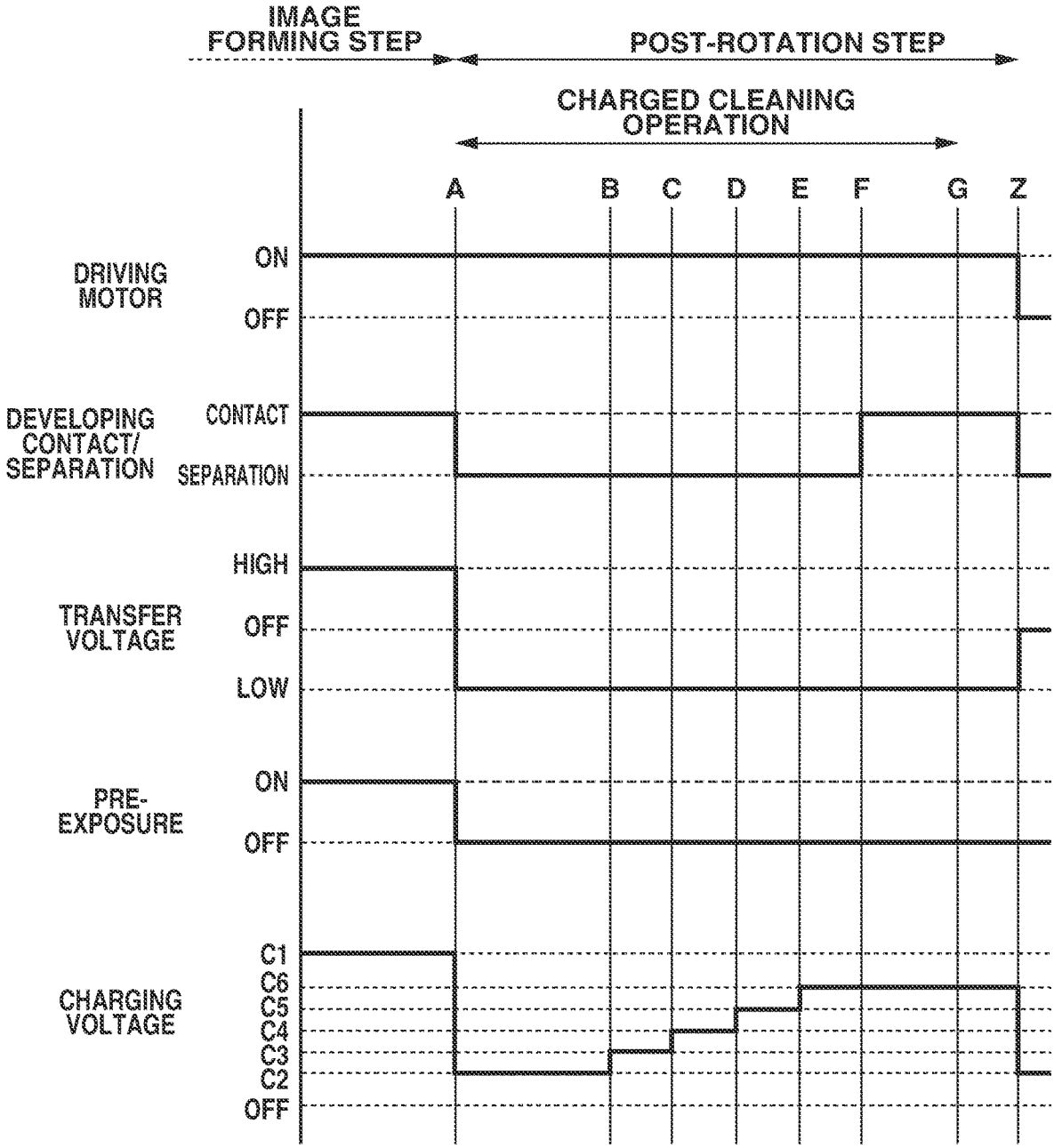
FIG. 12 is a timing chart of a charged cleaning operation according to the first modification.

FIG. 12 is a timing chart of the charged cleaning operation according to the first modification. In FIG. 12, the operations from the timing A to the timing C are similar to those of the first exemplary embodiment. A description thereof will thus be omitted. In the first modification, the charging voltage C4 (−900 V) is further switched to a charging voltage C5 (−950 V) at a timing D at which the photosensitive drum 1 has rotated by approximately one rotation since the timing C of switching to the charging voltage C4. The charging voltage C5 is switched to a charging voltage C6 (−1000 V) at a timing E at which the photosensitive drum 1 has rotated by approximately one rotation since the timing D of switching to the charging voltage C5. Such charging voltages C5 and C6 are also intended to maintain the surface potential of the charging roller 2 negatively higher than that of the photosensitive drum 1. The extension corresponding to the time period between the timing D and E increases the time to transfer the toner from the charging roller brush 21 to the charging roller 2, compared to the charged cleaning operation illustrated in FIG. 8 according to the first exemplary embodiment. The timing D and the timing E are not limited thereto as long as the surface potential of the charging roller 2 can be maintained negatively higher than that of the photosensitive drum 1. The change width of the charging voltage is not limited to 50 V, and may be variable based on the amount of change in the surface potential of the photosensitive drum 1.

Next, the developing sleeve 41 is brought into contact with the photosensitive drum 1 again at a timing F at which the photosensitive drum 1 has rotated by approximately one rotation since the timing E of switching to the charging voltage C6. In this way, the toner of negative polarity on the photosensitive drum 1 is transferred to the developing sleeve 41 at the developing portion c by a potential difference between the surface potential of the photosensitive drum 1 and the developing voltage, and collected into the developing unit 4.

In the first modification, the charged cleaning operation also ends at a timing G at which the photosensitive drum 1 has rotated by one rotation since the contact of the developing sleeve 41 with the photosensitive drum 1. In other words, the charged cleaning operation period is from the timing A to the timing G of FIG. 12. The duration of the charged cleaning operation according to the first modification is 2.8 sec. This period corresponds to approximately 18 rotations of the charging roller 2, during which the toner accumulated on the charging roller brush 21 can be sufficiently discharged to the charging roller 2, and the toner on the charging roller 2 can be charged to the negative polarity and transferred to the photosensitive drum 1. The charged cleaning operation time can be changed as appropriate based on the peripheral speed ratio between the charging roller 2 and the photosensitive drum 1 and the state of the adhering toner.

The operations after the timing F at which the charged cleaning operation ends are similar to those of the first exemplary embodiment. A period of 500 msec before the timing G is a time period for collecting the toner of negative polarity by the developing sleeve 41. In the post-rotation step after the timing G, the control unit 150 performs the operation for separating the developing sleeve 41 and controls various voltages and the driving motor M1 off at a timing Z. Then, a series of image output operations ends.

Like the first modification, even in the presence of the charging roller brush 21 serving as a cleaning member for the charging roller 2, similar operations and effects to those of the first exemplary embodiment can be obtained by extending the charged cleaning operation time. In the rotations during the extended time for discharging the toner from the charging roller brush 21, the effect of injection charging on the photosensitive drum 1 can be cancelled by further increasing the absolute value of the charging voltage stepwise.

A second modification will be described. In the configuration of an image forming apparatus 100 applied to the second modification, similar members to those of the first exemplary embodiment are designated by the same reference numerals. A description thereof will be omitted.

Figure 13:
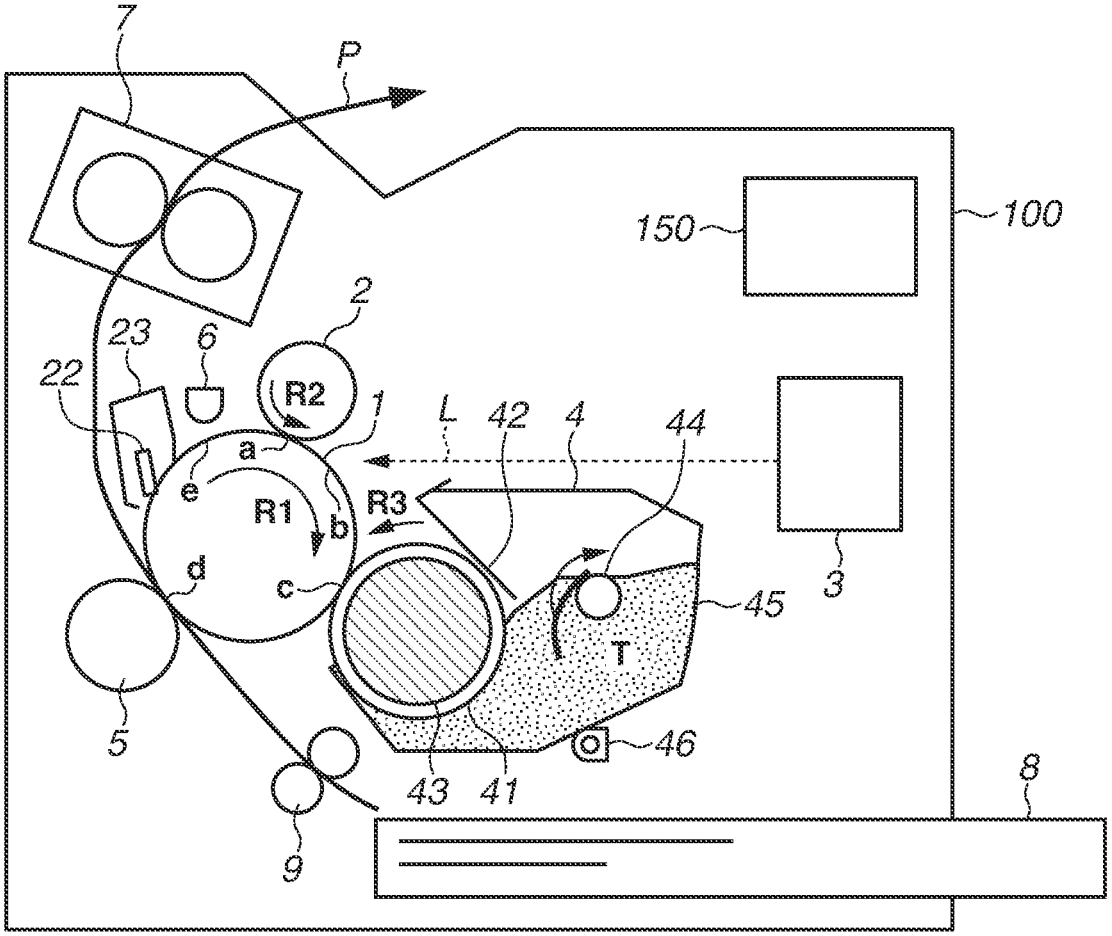
FIG. 13 is a diagram illustrating an image forming apparatus according to a second modification.

The second modification is characterized in that the image forming apparatus 100 having a similar configuration to that of the first exemplary embodiment includes a cleaning blade 22 serving as a cleaning member for the photosensitive drum 1. FIG. 13 is a schematic configuration diagram of the image forming apparatus 100 according to the second modification. The cleaning blade 22 is made of urethane rubber, and pressed against the surface of the photosensitive drum 1 with a predetermined pressure. Transfer residual toner on the photosensitive drum 1 is scrapped off by the cleaning blade 22 and stored into a cleaning container 23.

Even in the image forming apparatus 100 including the above-described cleaning blade 22, toner adheres to the charging roller 2. For example, the toner to be cleaned by the cleaning blade 22 may fail to be cleaned if the amount of toner to run into the cleaning blade 22 is large or if images are continuously formed. In particular, if the cleaning performance drops due to cumulative use of the cleaning blade 22, the amount of toner adhering to the charging roller 2 increases. In the second modification, the charging voltage is changed by performing voltage control in the charged cleaning operation based on the cumulative use of the photosensitive drum 1 and the cleaning blade 22. For that purpose, the image forming apparatus 100 according to the second modification includes a not-illustrated nonvolatile recording medium (memory) into which information about a cumulative number of rotations indicating the used state of the photosensitive drum 1 is written. In the second modification, a charged cleaning operation similar to that of the first exemplary embodiment is performed if an environmental sensor (not illustrated) determines that the environment is the H/H environment and the cumulative number of rotations exceeds 50% of the lifetime of the photosensitive drum 1. The timing to perform the charged cleaning operation is not limited to 50% of the lifetime of the photosensitive drum 1.

Since the charged cleaning operation is similar to that of the first exemplary embodiment, a detailed description thereof will be omitted.

Like the second modification, even in the presence of the cleaning blade 22 serving as a cleaning member for the photosensitive drum 1, similar operations and effects to those of the first exemplary embodiment can be obtained. In addition, by controlling the charging voltage based on the degree of toner adhesion to the charging roller 2, a suitable charged cleaning operation can be performed without unnecessarily increasing downtime.

A second exemplary embodiment will be described. In the configuration of an image forming apparatus 100 applied to the second exemplary embodiment, similar members to those of the first exemplary embodiment are designated by the same reference numerals. A description thereof will be omitted.

The image forming apparatus 100 according to the second exemplary embodiment includes no contact/separation cam 46 that can bring the developing sleeve 41 into contact with and separate the developing sleeve 41 from the photosensitive drum 1. This enables cost reduction by reducing the number of parts such as the contact/separation cam 46, and reducing the size of image forming apparatus 100. A major characteristic of the image forming apparatus 100 according to the second exemplary embodiment is that the developing voltage is changed in synchronization with the change of the charging voltage in the charged cleaning operation. The schematic configuration diagram of the image forming apparatus 100 according to the second exemplary embodiment is the same as FIG. 1 except that the contact/separation cam 46 is not included.

1. Charged Cleaning Operation

Figure 14:
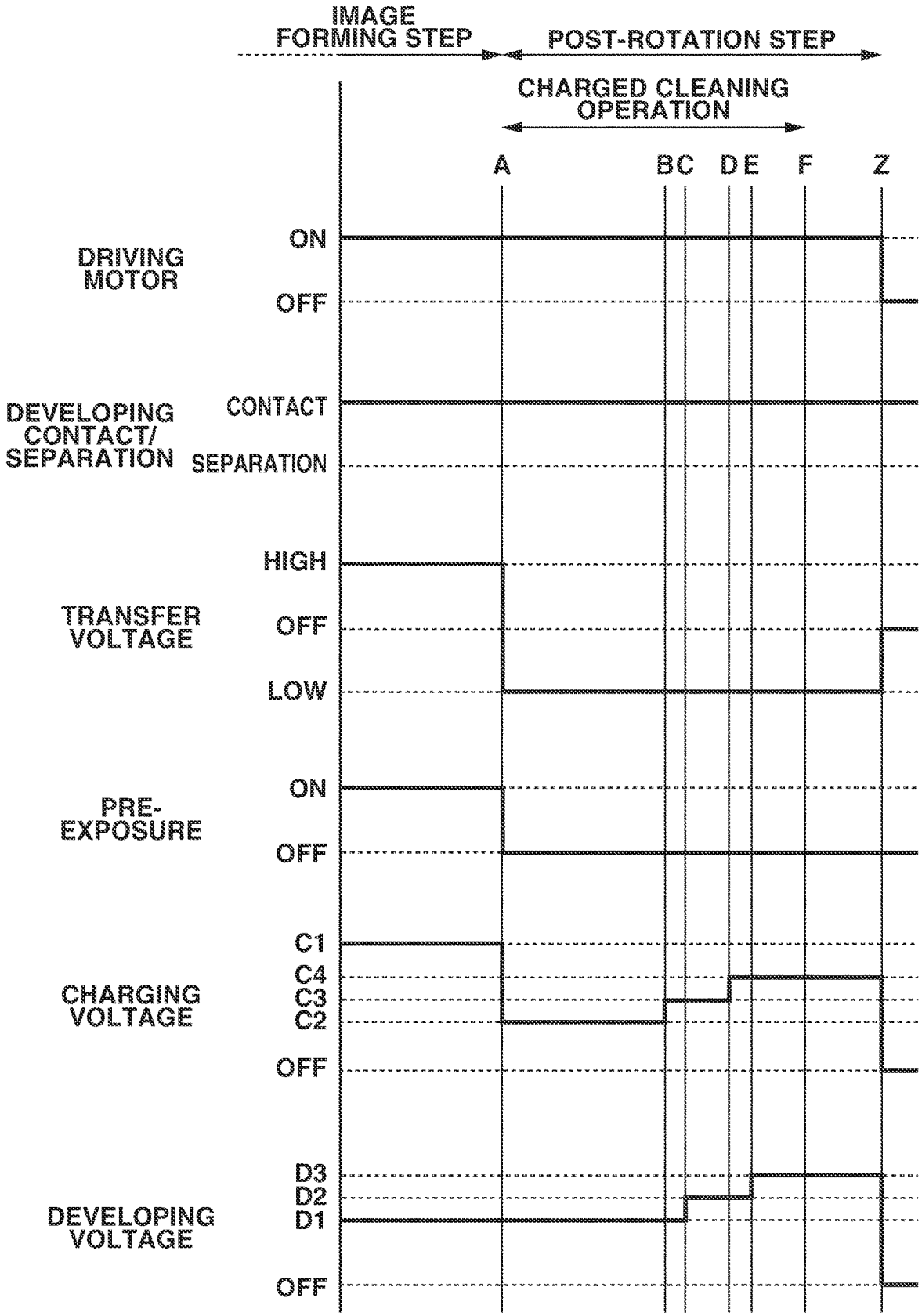
FIG. 14 is a timing chart of a charged cleaning operation according to a second exemplary embodiment.

FIG. 14 is a timing chart of the charged cleaning operation according to the second exemplary embodiment. In the second exemplary embodiment, the charged cleaning operation is performed with the developing sleeve 41 in contact with the photosensitive drum 1. Like the first exemplary embodiment, the post-rotation step for performing the charged cleaning operation starts at a timing A at which the image forming operation ends and the recording material P exits the transfer portion d. At this timing, the charging voltage applied to the charging roller 2 is switched from the charging voltage C1 during image formation (−1300 V) to the charging voltage C2 for charged cleaning (−800 V). The timing A of switching the charging voltage is the start timing of the charged cleaning operation. At the timing A, the pre-exposure unit 6 is turned off. At the same timing A, the transfer voltage applied to the transfer roller 5 is switched from HIGH (+1000 V) to LOW (−1000 V).

After the pre-exposure unit 6 is turned off, the surface potential of the photosensitive drum 1 approaches the charging voltage C2 (−800 V) because of injection charging from the charging voltage. The resulting back contrast Vback, which is a potential difference between the surface potential of the photosensitive drum 1, and the developing voltage D1 (−300 V) is approximately 400 V to 500 V.

Figure 15:
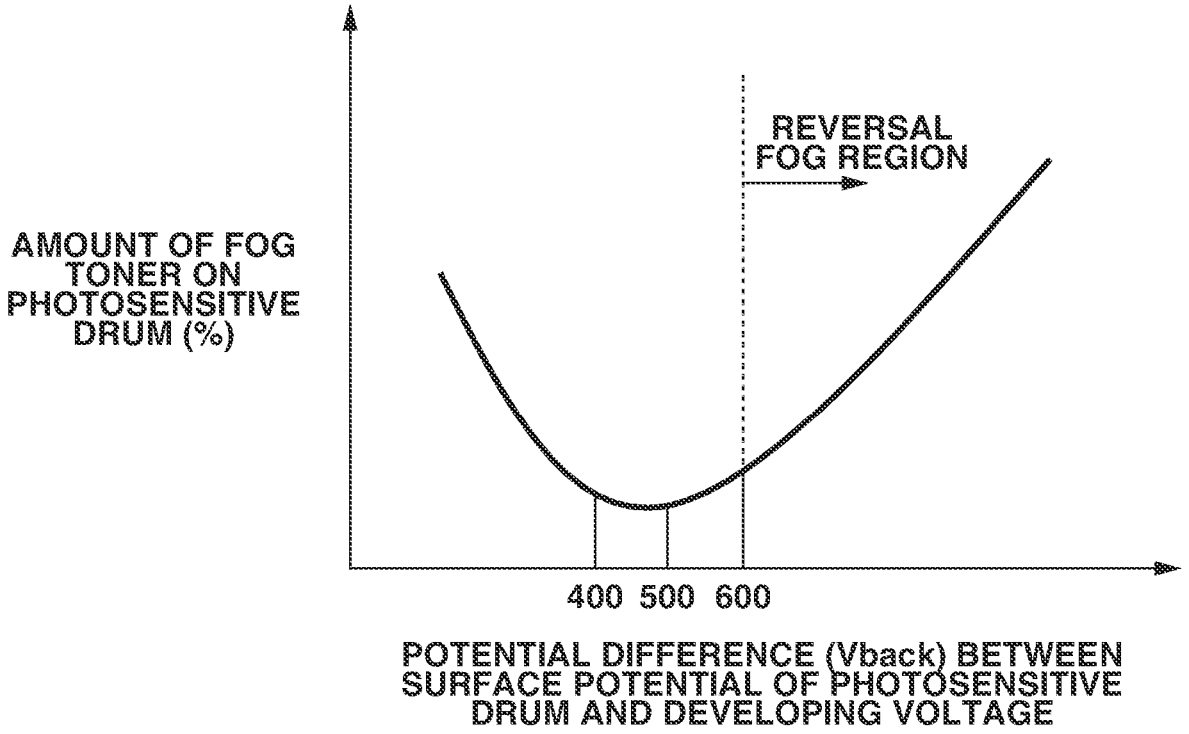
FIG. 15 is a graph illustrating a fog curve on a photosensitive drum according to the second exemplary embodiment.

FIG. 15 illustrates a relationship between the back contrast Vback, which is the potential difference between the surface potential of the photosensitive drum 1, and the developing voltage and the amount of fog toner adhering to the surface of the photosensitive drum 1 according to the second exemplary embodiment. The amount of fog toner was measured by taping and peeling off the toner on the photosensitive drum 1 with a mylar tape, attaching the mylar tape to a reference sheet, and measuring the toner density under a reflection-type densitometer (TC-6DS/A) manufactured by Tokyo Denshoku, Co., Ltd. The amounts of fog toner were calculated from the amounts of toner on the photosensitive drum 1 when an image forming operation was performed using the image forming apparatus 100 and the latent image was developed at different back contrasts Vback without using a recording material P. As illustrated in FIG. 15, the amount of fog toner on the photosensitive drum 1 hardly changes if the back contrast Vback falls within the range of 400 and 500 V. The amount of fog toner starts to increase at around 600 V. The reason is that the higher the back contrast Vback is, the more likely the toner charged to the positive polarity reversely charged to the normal polarity is to adhere to the photosensitive drum 1. The fog caused by the adhesion of the toner of positive polarity to the photosensitive drum 1 will be referred to as reversal fog.

At a timing B at which the photosensitive drum 1 has rotated by approximately two rotations since the timing A of switching the charging voltage to the charging voltage C2, the charging voltage is switched from the charging voltage C2 at the start of the charged cleaning operation to the charging voltage C3 (−850 V). In the second exemplary embodiment, at a timing C at which the surface of the photosensitive drum 1 provided at the charging portion a when switching to the charging voltage C3 reaches the developing portion c, the developing voltage D1 (−300 V) is switched to a developing voltage D2 (−350 V) in synchronization with the switching of the charging voltage. Through this operation, the back contrast Vback, which is the potential difference between the surface potential of the photosensitive drum 1, and the developing voltage after the application of the charging voltage can thereby be stably maintained at approximately 500 V to prevent fog on the photosensitive drum 1.

The reason why the back contrast Vback can be maintained substantially constant will be described. The developing sleeve 41 and the photosensitive drum 1 according to the second exemplary embodiment rotate with a surface moving speed difference therebetween. The reason is that the surface moving speed of the developing sleeve 41 is to be set to be higher than that of the photosensitive drum 1 to secure the amount of toner T desirable for the development of the latent image on the photosensitive drum 1. In the second exemplary embodiment, the surface moving speed of the developing sleeve 41 is 140% of that of the photosensitive drum 1. Accordingly, as illustrated in FIG. 5, the surface moving speed difference suggests that charges move from the photosensitive drum 1 to the developing sleeve 41 and cause injection charging to the developing sleeve 41. However, the surface of the developing sleeve 41 is constantly coated with a sufficient amount of toner T. In other words, the periphery of the developing sleeve 41 is covered with the toner T, which is an insulator having a high resistance. Such a configuration makes the movement of charges from the photosensitive drum 1 to the developing sleeve 41 difficult and thereby suppresses injection charging. In this way, injection charging hardly occurs even with the configuration in which the developing sleeve 41 and the photosensitive drum 1 have a peripheral speed difference. The surface potential of the photosensitive drum 1 can therefore be stably controlled to stabilize the back contrast Vback.

Next, the charging voltage is switched from the charging voltage C3 to the charging voltage C4 (−900 V) at a timing D at which the photosensitive drum 1 has rotated by approximately one rotation since the timing B of switching the charging voltage to the charging voltage C3. The developing voltage is switched from the developing voltage D2 to a developing voltage D3 (−400 V) at a timing E at which the surface of the photosensitive drum 1 located at the charging portion a when the charging voltage is switched to the charging voltage C4 reaches the developing portion c. In this way, the back contrast Vback, which is the potential difference between the surface potential of the photosensitive drum 1 and the developing voltage after the application of the charging voltage, can thereby be stably maintained at approximately 500 V to suppress fog on the photosensitive drum 1.

As described above, in the second exemplary embodiment, toner is discharged from the charging roller 2 and collected by the developing sleeve 41 in the charged cleaning operation. In the second exemplary embodiment, the charged cleaning operation ends at a timing F at which the photosensitive drum 1 has rotated by one rotation since the switching of the charging voltage to the charging voltage C4. In other words, the charged cleaning operation period is from the timing A to the timing F in FIG. 14. The duration of the charged cleaning operation in the second exemplary embodiment is 1.8 sec. This duration corresponds to approximately 11 rotations of the charging roller 2. The toner T on the charging roller 2 is sufficiently charged to the negative polarity by such frictional sliding, and transferred to the photosensitive drum 1. The charged cleaning time can be changed as appropriate depending on the speed ratio between the charging roller 2 and the photosensitive drum 1 and the state of the adhering toner.

After the timing F at which the charged cleaning operation ends, the control unit 150 controls various voltages and the driving motor M1 to be off at a timing Z. Then, a series of image output operations ends.

2. Effects of Charging Voltage Control and Developing Voltage Control During Charged Cleaning Operation The effects of the charging voltage control and the developing voltage control during the charged cleaning operation according to the second exemplary embodiment were examined by experiment. Image formation was started with a charging voltage of −1300 V and a developing voltage of −300 V, and image defects when an image having a printing ratio of 10% was printed on 5000 sheets by two-sheet intermittent operations were observed. In the second exemplary embodiment, correction control illustrated in FIG. 14 was performed on the charging voltage and the developing voltage during the charged cleaning operation executed in each intermittent operation. By contrast, in a second comparative example, the charged cleaning operation was performed with the same charging voltage and developing voltage as those during image formation, without correcting the charging voltage or the developing voltage. Table 2 illustrates the results of image defects observed at respective numbers of images formed.

TABLE 2

| Number of formed images (sheets) | 500 | 1000 | 3000 | 5000 |
|---|---|---|---|---|
| Second comparative example | ○ | x | x | x |
| Second exemplary embodiment | ○ | ○ | ○ | ○ |

In Table 2, the mark o represents a state where no image defect occurred on the recording material P. The mark x represents a state where an image defect such as fog toner, streaks, and dots was visually observed on the recording material P.

In the second comparative example, an image defect occurred when 1000 images were formed. The reason is that the charged cleaning operation was performed without correcting the charging voltage or the developing voltage during the charged cleaning operation. In other words, the reason is considered to be that a large amount of toner adhered to the charging roller 2 and the toner was not sufficiently transferred from the charging roller 2 to the photosensitive drum 1. More specifically, the discharge of the toner from the charging roller 2 and the amount of fog on the surface of the photosensitive drum 1 increased because of the increased surface potential of the photosensitive drum 1 due to injection charging and the decreased potential difference between the charging roller 2 and the surface potential of the photosensitive drum 1.

By contrast, in the second exemplary embodiment, image defects remained in a visually unnoticeable level. Possible reasons are that potential increase as much as injected potential due to frictional sliding was successfully cancelled by performing the charging voltage control and the developing voltage control based on the rotation of the photosensitive drum 1 during the charged cleaning operation to change the value of the charging voltage at appropriate timing. In addition, the back contrast Vback was successfully maintained at a desired level by changing the developing voltage based on the change in the charging voltage.

The image forming apparatus 100 used in the second exemplary embodiment, including no contact/separation cam 46 that can bring the developing sleeve 41 into contact with and separate the developing sleeve 41 from the photosensitive drum 1, has the following characteristics.

The control unit 150 controls the developing voltage applied to the developing sleeve 41 when the surface of the photosensitive drum 1 to which the charging voltage is applied reaches the developing portion c, in the following manner A second developing voltage applied when the surface of the photosensitive drum 1 to which the second charging voltage having an absolute value greater than that of the first charging voltage is applied reaches the developing portion c has an absolute value greater than that of a first developing voltage when the surface of the photosensitive drum 1 to which the first charging voltage is applied reaches the developing portion c.

As described above, according to the second exemplary embodiment, the charging voltage is switched to increase negatively stepwise during the period of the charged cleaning operation in the post-rotation step. The developing voltage is also switched to increase negatively in synchronization with the switching timing of the charging voltage. This can maintain the surface potential of the charging roller 2 negatively higher than the surface potential of the photosensitive drum 1, and maintain the back contrast Vback, which is the potential difference between the surface potential of the photosensitive drum 1 and the developing voltage. The transfer of fog toner on the photosensitive drum 1 can thereby be prevented even in the state where the developing sleeve 41 is in contact with the photosensitive drum 1. In addition, an electric field desirable for the transfer of toner of negative polarity to the photosensitive drum 1 can be obtained at the charging portion a. This can prevent toner accumulation on the charging roller 2 and provide a favorable image without image defects such as streaks and dots.

The pre-exposure unit 6 according to the second exemplary embodiment is configured to directly irradiate the discharging portion e of the photosensitive drum 1 with light. However, it is not limited thereto. For example, to discharge the surface of the photosensitive drum 1, the tips of a brush member made of conductive fibers, such as a fur brush, may be brought into contact with the photosensitive drum 1. If a light guide having an irradiation angle is used, the timing to turn on/off the pre-exposure unit 6 may be changed as appropriate.

The charging member according to the second exemplary embodiment is described to be a roller-shaped member. However, it is not limited thereto. Rotating members of other forms may also be suitably used. For example, a charging member of endless belt shape wound around a plurality of support rollers may be used, and one of the plurality of support rollers may be brought into contact with the photosensitive drum 1 via the belt.

The charged cleaning operation according to the second exemplary embodiment is described to be performed in the post-rotation step during the non-image forming operation. However, it is not limited thereto, and the charged cleaning operation may be performed at any timing during the non-image forming operation. For example, if the number of output images reaches or exceeds a predetermined threshold in executing a job in the printing step, the charged cleaning operation can be performed by extending the sheet interval.

While the charged cleaning operation according to the second exemplary embodiment is limited to the case where the H/H environment is detected by the detection unit serving as the environmental sensor, the charged cleaning operation can also be applied to other environments.

The charging voltage at the start of the post-rotation step may be controlled to increase simply stepwise without being changed from the image forming step. In such a case, to stabilize the back contrast Vback, which is the potential difference between the surface potential of the photosensitive drum 1 and the developing voltage during development and collection, either the surface potential of the photosensitive drum 1 is controlled to decrease or the developing voltage is controlled to increase.

The charging voltage may be controlled to increase linearly from the charging voltage C2 for charged cleaning so that the charging voltage increases gradually from the start of the charged cleaning operation to the end of the charged cleaning operation.

In the second exemplary embodiment, the toner of magnetic one-component developer is used as the developer. However, nonmagnetic one-component developer may be used.

A third exemplary embodiment will now be described. In the configuration of an image forming apparatus 100 according to the third exemplary embodiment, the same members as those of the first exemplary embodiment are designated by the same reference numerals. A description thereof will be omitted.

It is a major characteristic of the image forming apparatus 100 according to the third exemplary embodiment that, like the second exemplary embodiment, no contact/separation cam 46 capable of bringing the developing sleeve 41 into contact with and separating the developing sleeve 41 from the photosensitive drum 1 is included, and that the light amount of the pre-exposure unit 6 can be adjusted. The light source wavelength of the pre-exposure unit 6 has a peak within the range of 400 nm to 800 nm, and the light amount on the surface of the photosensitive drum 1 can be adjusted within the range of 0.1 μW to 50 μW. The light amount can be adjusted by adjusting the voltage applied to the light source. The schematic configuration diagram of the image forming apparatus 100 according to the third exemplary embodiment is the same as that of FIG. 1 except that the contact/separation cam 46 is not included.

1. Charged Cleaning Operation

Figure 16:
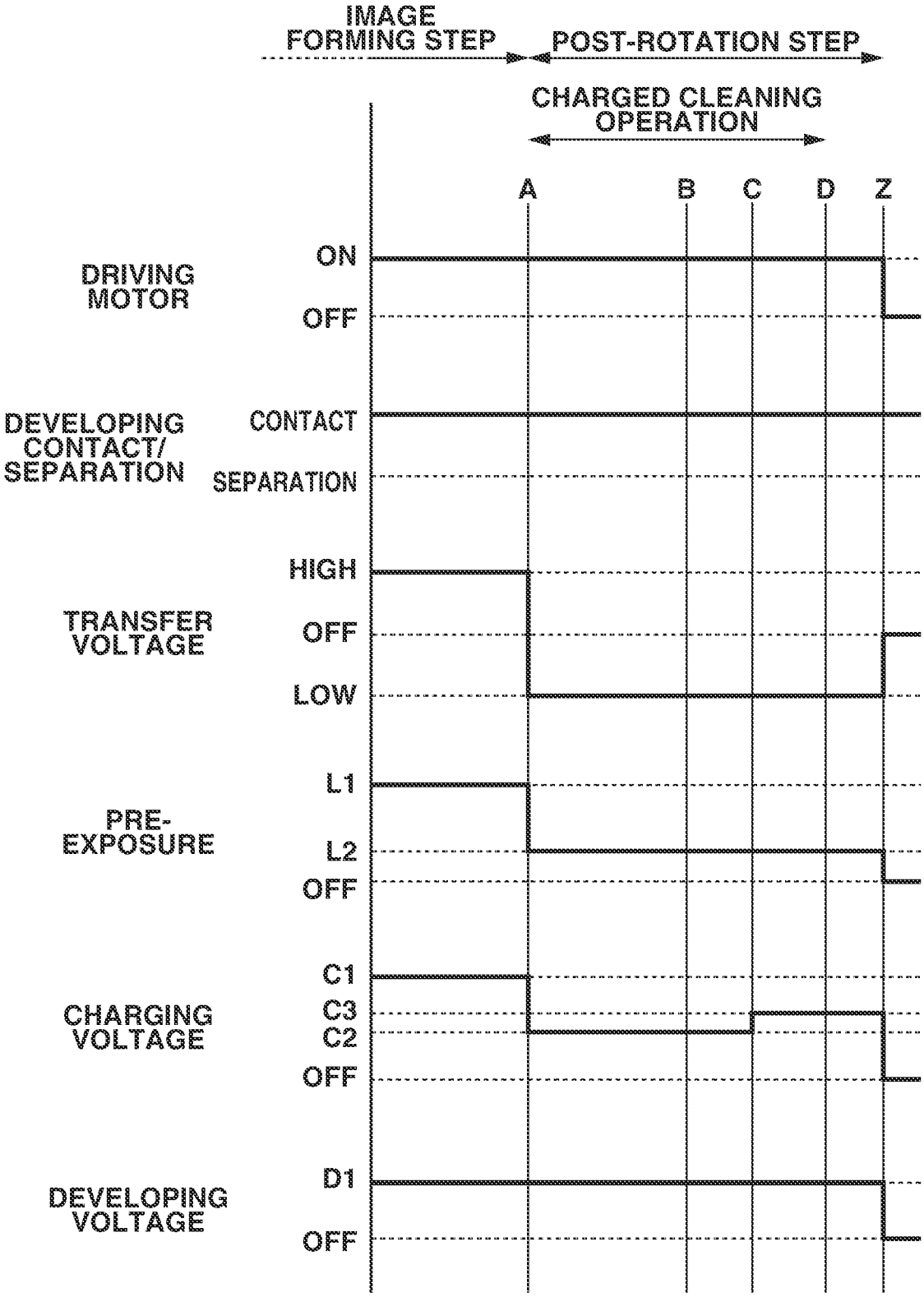
FIG. 16 is a timing chart of a charged cleaning operation according to a third exemplary embodiment.

FIG. 16 is a timing chart of the charged cleaning operation according to the third exemplary embodiment. Like the second exemplary embodiment, the charged cleaning operation is performed with the developing sleeve 41 being in contact with the photosensitive drum 1. The post-rotation step starts at a timing A at which the printing step ends and the recording material P exits the transfer portion d. At this timing A, the charging voltage applied to the charging roller 2 is switched from the charging voltage C1 during image forming (−1300 V) to the charging voltage C2 (−800 V). At the same timing A, the transfer voltage applied to the transfer roller 5 is switched from HIGH (+1000 V) to LOW (−1000 V).

At this time, the photosensitive drum 1 has a uniform surface potential of approximately −700 V, which is the dark area potential Vd. However, if the charging voltage continues to be applied in the H/H environment with the pre-exposure unit 6 being off, the surface potential of the photosensitive drum 1 increases due to injection charging from the charging roller 2 and approaches the charging voltage C2 of −800 V.

The pre-exposure unit 6 is then switched from an exposure amount L1 (40 μW) to a small exposure amount L2 (0.5 μW) and starts irradiation in a period between the timing A and timing B when the photosensitive drum 1 has rotated by approximately two rotations. The surface potential of the photosensitive drum 1 upstream of the charging portion a on the photosensitive drum 1 in the rotation direction is thereby set to approximately −700 V. To be more exact, the exposure amount is switched at a timing at which the surface of the photosensitive drum 1 located at the charging portion a when the charging voltage is switched to the charging voltage C2 reaches the exposure irradiation position (discharging portion) e of the pre-exposure unit 6. The exposure amount may be switched at the timing A as illustrated in FIG. 16. The pre-exposure unit 6 may be once turned off between the timing A and the timing B, and started up with the exposure amount L2. In either case, the surface potential of the photosensitive drum 1 upstream of the charging portion a in the rotation direction is made negatively lower than the surface potential of the charging roller 2. Accordingly, the timing to switch the light amount of the pre-exposure unit 6 is not limited to the above-described timing as long as the surface potential of the photosensitive drum 1 upstream of the charging portion a of the photosensitive drum 1 in the rotation direction can be made negatively lower than the surface potential of the charging roller 2. While the area of the photosensitive drum 1 irradiated with the exposure amount L2 of light from the pre-exposure unit 6 is brought closer to −800 V by injection charging at the charging portion a, the surface potential varies depending on the use environment. Thus, the exposure amount L2 of the pre-exposure unit 6 may be changed based on the amount of change in the surface potential of the photosensitive drum 1.

In this way, like the second exemplary embodiment, the back contrast Vback, which is the potential difference between the surface potential of the photosensitive drum 1 and the developing voltage after the application of the charging voltage, can be maintained approximately between 400 V and 500 V, whereby fog on the photosensitive drum 1 can be suppressed.

Next, the charging voltage is switched from the charging voltage C2 to the charging voltage C3 (−850 V) at a timing C at which the photosensitive drum 1 has rotated by approximately one rotation since the timing B of irradiation with the exposure amount L2 of light by the pre-exposure unit 6. The purpose is to more reliably maintain the state where the surface potential of the charging roller 2 is negatively higher than that of the photosensitive drum 1. Thus, the timing C to switch the charging voltage is not limited to the above-described timing as long as the surface potential of the charging roller 2 can be maintained negatively higher than that of the photosensitive drum 1. For this purpose, the change width of the charging voltage is not limited to 50 V, and may be variable based on the amount of change in the surface potential of the photosensitive drum 1.

In the third exemplary embodiment, like the second exemplary embodiment, toner is discharged from the charging roller 2 and collected by the developing sleeve 41 in the charged cleaning operation. Thus, there is no clear distinction between the charged cleaning operation and the developing and collection operation. The duration of the charged cleaning operation and the developing and collection operation in the third exemplary embodiment is 1.5 sec. This duration is equivalent to approximately nine rotations of the charging roller 2. The toner on the charging roller 2 is sufficiently charged to the negative polarity by such frictional sliding, and transferred to the photosensitive drum 1. The charged cleaning operation time can be changed as appropriate depending on the speed ratio between the charging roller 2 and the photosensitive drum 1, and the state of the adhering toner.

After the timing D at which 1.5 sec has elapsed since the start timing A of the charged cleaning operation, the control unit 150 controls various voltages and the driving motor M1 to be off at a timing Z. Then, a series of image output operations ends.

2. Effects of Charging Voltage Control, Developing Voltage Control, and Pre-Exposure Control During Charged Cleaning Operation The effects of the charging voltage control, developing voltage control, and pre-exposure control during the charged cleaning operation according to the third exemplary embodiment were examined by experiment. Image formation was started with a charging voltage of −1300 V, a developing voltage of −300 V, and a pre-exposure amount of 40 μW, and image defects when an image having a printing ratio of 10% was printed on 5000 sheets by two-sheet intermittent operations were observed. In the third exemplary embodiment, correction control illustrated in FIG. 16 was performed on the charging voltage, the develop voltage, and the pre-exposure amount during the charged cleaning operation executed in each intermittent operation. By contrast, in a third comparative example, the charged cleaning operation was performed with the same charging voltage, developing voltage, and pre-exposure amount as those during the image formation, without correcting the charging voltage, the developing voltage, or the pre-exposure amount.

TABLE 3

| Number of formed images (sheets) | 500 | 1000 | 3000 | 5000 |
|---|---|---|---|---|
| Third comparative example | ○ | x | x | x |
| Third exemplary embodiment | ○ | ○ | ○ | ○ |

The mark o in the table represents a state where no image defect occurred on the recording material P. The mark x represents a state where an image defect such as fog toner, streaks, and dots was visually observed on the recording material P.

In the third comparative example, an image defect occurred when 1000 images were formed. The reason is that the charged cleaning operation was performed without correcting the charging voltage, the developing voltage, and the pre-exposure amount during the charged cleaning operation. The reason for the image defect in the third comparative example is considered to be that a discharge occurred between the surface of the photosensitive drum 1 entering the charging portion a and the charging roller 2 since the exposure amount of the pre-exposure unit 6 was the same as during image formation. In other words, the toner adhering to the charging roller 2 was charged to the reverse polarity by the discharge, and the toner was not electrostatically sufficiently transferred from the charging roller 2 to the photosensitive drum 1.

By contrast, in the third exemplary embodiment, image defects remained in a visually unnoticeable level. Possible reasons are the followings. Potential increases as much as injected potentials due to frictional sliding were successfully cancelled by performing the charging voltage control, the developing voltage control, and the pre-exposure control based on the rotation of the photosensitive drum 1 during the charged cleaning operation to change the charging voltage, the developing voltage, and the pre-exposure amount at appropriate timing. In addition, the back contrast Vback, which is the potential difference between the surface potential of the photosensitive drum 1 and the developing voltage applied to the developing sleeve 41, was successfully maintained, whereby the occurrence of fog toner was successfully prevented.

The image forming apparatus 100 used in the third exemplary embodiment, including no contact/separation cam 46 that can bring the developing sleeve 41 into contact with and separate the developing sleeve 41 from the photosensitive drum 1, has the following characteristics.

The image forming apparatus 100 includes the pre-exposure unit 6 that exposes the surface of the photosensitive drum 1 downstream of the transfer portion d and upstream of the charging portion a in the rotation direction of the photosensitive drum 1. In the charged cleaning operation, the control unit 150 controls formation of a potential difference between charging roller 2 and the photosensitive drum 1 in the direction in which electrostatic force directed from the charging roller 2 to the photosensitive drum 1 acts on the toner of normal polarity so that no discharge occurs between the charging roller 2 and the photosensitive drum 1.

As described above, according to the third exemplary embodiment, the pre-exposure unit 6 irradiates the surface of the photosensitive drum 1 with a small amount of light during the period of the charged cleaning operation in the post-rotation step. The surface potential of the charging roller 2 can thereby be maintained negatively higher than that of the photosensitive drum 1. In this way, an electric field desirable to transfer the toner of negative polarity to the photosensitive drum 1 can be obtained. In addition, the amount of increase in the charging voltage during the charged cleaning operation can be reduced by reducing the absolute value of the surface potential of the photosensitive drum 1 using the pre-exposure unit 6. This can reduce the risk of discharge and a deterioration of the photosensitive drum 1. The back contrast Vback, which is the potential difference between the surface potential of the photosensitive drum 1 and the developing voltage, can further be maintained. In this way, the transfer of fog toner on the photosensitive drum 1 can be prevented. This can reduce toner accumulation on the charging roller 2 and provide a favorable image without image defects such as streaks and dots.

One of the technical features of the third exemplary embodiment is to control the pre-exposure amount. In the third exemplary embodiment, the pre-exposure amount is adjusted to 40 μW during the image forming operation, and 0.5 μW during the charged cleaning operation. The pre-exposure amount in the image forming operation may be such that the surface potential of the photosensitive drum 1 after transfer is uniformized so that a uniform dark area potential Vd can be formed by the discharge at the charging portion a. Since the charging voltage is −1300 V and the discharge start voltage is −750 V, the surface potential of the photosensitive drum 1 after the pre-exposure may be −750 V or less. For that purpose, the pre-exposure amount may be 10 μW or more and 50 μW or less. However, the smaller the pre-exposure amount is, the smaller the discharge amount is. Thus, the smaller the amount of charge cancel is smaller. In such a case, suitable image formation can be difficult. The greater the pre-exposure amount is, the more the deterioration of the photosensitive drum 1 is promoted. In the image forming operation, an exposure amount of 20 μW or more and 40 μW or less can therefore be more desirable. On the other hand, the pre-exposure amount in the charged cleaning operation may be such that the amount of potential increase due to injection charging can be cancelled by the pre-exposure. In the third exemplary embodiment, the pre-exposure amount in the charged cleaning operation is set to 0.5 μW. However, it is not limited thereto. A pre-exposure amount of 0.1 μW or more and 10 μW or less can suitably cancel the injected potentials without causing a discharge deterioration of the photosensitive drum 1 by the pre-exposure.

The pre-exposure unit 6 according to the third exemplary embodiment is configured to directly irradiate the discharging portion e of the photosensitive drum 1 with light. However, it is not limited thereto. For example, to discharge the surface of the photosensitive drum 1, the tips of a brush member made of conductive fibers, such as a fur brush, may be brought into contact with the photosensitive drum 1. If a light guide having an irradiation angle is used, the timing to turn on/off the pre-exposure unit 6 may be changed as appropriate.

In the third exemplary embodiment, the surface potential of the photosensitive drum 1 is adjusted by adjusting the light amount of the pre-exposure unit 6. However, the exposure unit 3 serving as the exposure unit for image forming parts may include a weak exposure (referred to as background exposure) function aside from the laser beam L, and the surface potential of the photosensitive drum 1 may be thereby adjusted.

The charging member according to the third exemplary embodiment is described to be a roller-shaped member. However, it is not limited thereto. Rotating members of other forms may also be suitably used. For example, a charging member of endless belt shape wound around a plurality of support rollers may be used, and one of the plurality of support rollers may be brought into contact with the photosensitive drum 1 via the belt.

The charged cleaning operation according to the third exemplary embodiment is described to be performed in the post-rotation step during the non-image forming operation. However, it is not limited thereto, and the charged cleaning operation may be performed at any timing during the non-image forming operation. For example, if the number of output images reaches or exceeds a predetermined threshold while executing a job in the printing step, the charged cleaning operation can be performed by extending the sheet interval.

While the charged cleaning operation according to the third exemplary embodiment is limited to the case where the H/H environment is detected by the detection unit serving as the environmental sensor, the charged cleaning operation can be applied to other environments.

The charging voltage at the start of the post-rotation step may be controlled to increase simply stepwise without being changed from the image forming step.

The charging voltage may be controlled to increase linearly from the charging voltage C2 for charged cleaning so that the charging voltage increases gradually from the start of the charged cleaning operation to the end of the charged cleaning operation.

In the third exemplary embodiment, the toner of magnetic one-component developer is used as the developer. However, nonmagnetic one-component developer may be used.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-033352, filed Feb. 26, 2019, which is hereby incorporated by reference herein in its entirety.

What is claimed is:

1. An image forming apparatus that forms a toner image on a recording material, the image forming apparatus comprising:

a rotatable image bearing member;

a charging member configured to make contact with the image bearing member to form a charging portion, and charge a surface of the image bearing member at the charging portion;

a driving source configured to transmit a driving force to the charging member so that a surface of the charging member in contact with the image bearing member has a speed difference from the surface of the image bearing member;

a voltage application unit configured to apply a direct-current (DC) charging voltage to the charging member;

a developing member configured to make contact with the image bearing member to form a developing portion, and supply toner charged to normal polarity to the image bearing member to form a toner image at the developing portion;

a transfer member configured to make contact with the image bearing member to form a transfer portion, and transfer the toner image formed on the surface of the image bearing member to a recording material at the transfer portion; and, a control unit configured to control:

an image forming operation for forming the toner image on the recording material, a cleaning operation for cleaning the charging member by transferring toner adhering to the surface of the charging member from the charging member to the image bearing member and collecting the transferred toner with the developing member, and in the cleaning operation, the voltage application unit to apply only the DC charging voltage to the charging member, so that, a first DC charging voltage, forming a potential difference between the charging member and the image bearing member, is applied to the charging member, and then a second DC charging voltage, having the same polarity as that of the first DC charging voltage and an absolute value of the DC charging voltage greater than that of the first DC charging voltage, is applied to the charging member, wherein the potential difference is in a direction in which electrostatic force directed from the charging member to the image bearing member acts on the toner charged to the normal polarity.

2. The image forming apparatus according to claim 1, wherein a surface moving speed of the charging member is greater than or equal to 105% and less than or equal to 120% of that of the image bearing member.

3. The image forming apparatus according to claim 1, wherein the control unit further controls the first DC charging voltage and the second DC charging voltage, applied to the charging member, so that no discharge occurs between the charging member and the image bearing member in the cleaning operation.

4. The image forming apparatus according to claim 1, wherein the control unit further controls the voltage application unit so that an ending DC charging voltage applied to the charging member when the cleaning operation ends has an absolute value greater than that of a starting DC charging voltage applied when the cleaning operation starts.

5. The image forming apparatus according to claim 4, wherein when the cleaning operation starts, an image forming DC charging voltage applied to the charging member during the image forming operation is switched to the starting DC charging voltage, and wherein when the cleaning operation ends the image bearing member will have rotated by at least one rotation since application of the second DC charging voltage applied in a period of the cleaning operation.

6. The image forming apparatus according to claim 1, wherein the control unit further controls the voltage application unit so that the first DC charging voltage changes to the second DC charging voltage stepwise in the cleaning operation.

7. The image forming apparatus according to claim 1, wherein the control unit further controls the voltage application unit so that steps in the DC charging voltage occur at least at each rotation of the image bearing member.

8. The image forming apparatus according to claim 1, wherein the control unit further controls the voltage application unit so that the DC charging voltage increases gradually from when the cleaning operation starts to when the cleaning operation ends.

9. The image forming apparatus according to claim 1, further comprising a second voltage application unit configured to apply a voltage to the developing member with the voltage application unit being referred to as a first voltage application unit, wherein the control unit is configured to control the first voltage application unit and the second voltage application unit so that a second developing voltage applied to the developing member when the surface of the image bearing member to which the second DC charging voltage is applied reaches the developing portion has an absolute value greater than that of a first developing voltage applied to the developing member when the surface of the image bearing member to which the first DC charging voltage is applied reaches the developing portion, and wherein the first developing voltage and the second developing voltage have same polarity.

10. The image forming apparatus according to claim 1, further comprising an exposure unit configured to expose the surface of the image bearing member downstream of the transfer portion of the image bearing member and upstream of the charging portion in a rotation direction of the image bearing member, wherein the control unit is configured to control the exposure unit so that no discharge occurs between the charging member and the image bearing member.

11. The image forming apparatus according to claim 1, wherein the control unit is configured to control the cleaning operation to be executed based on an environment where the image forming apparatus is used.

12. The image forming apparatus according to claim 11, further comprising a detection unit configured to detect the environment where the image forming apparatus is used, wherein the control unit is configured to, if the detection unit detects that the environment is a high-temperature high-humidity environment, control the cleaning operation to be executed.

13. The image forming apparatus according to claim 12, wherein the control unit is configured to calculate an absolute moisture content in air from the environment detected by the detection unit, and if the absolute moisture content is 15.0 $g/m^3$ or more, control the cleaning operation for the high-temperature high-humidity environment to be executed.

14. The image forming apparatus according to claim 1, wherein the control unit is configured to control the cleaning operation to be executed based on a use state of the image bearing member.

15. The image forming apparatus according to claim 14, wherein the use state of the image bearing member is a cumulative number of rotations of the image bearing member.

16. The image forming apparatus according to claim 1, wherein the developing member is configured to collect residual toner remaining on the surface of the image bearing member, untransferred to the recording material in the image forming operation.

17. The image forming apparatus according to claim 16, wherein the toner is one-component developer.

18. An image forming apparatus comprising:

a rotatable image bearing member;

a charging member configured to make contact with the image bearing member to form a charging portion, and charge a surface of the image bearing member at the charging portion;

a voltage application unit configured to apply a direct-current (DC) charging voltage to the charging member;

a developing member configured to make contact with the image bearing member to form a developing portion, and supply toner charged to normal polarity to the image bearing member to form a toner image at the developing portion;

a transfer member configured to make contact with the image bearing member to form a transfer portion, and transfer the toner image formed on the surface of the image bearing member to a recording material at the transfer portion; and a control unit configured to control the voltage application unit, wherein the control unit is configured to control an image forming operation for forming the toner image on the recording material in the transfer portion and a cleaning operation for cleaning the charging member by transferring toner adhering to a surface of the charging member from the charging member to the image bearing member and collecting the transferred toner with the developing member, to be executed, wherein, in the cleaning operation, the control unit is configured to control the voltage application unit to apply only the DC charging voltage to the charging member, so that a first DC charging voltage forming a potential difference between the charging member and the image bearing member is applied to the charging member, and then a second DC charging voltage having a same polarity as that of the first DC charging voltage and an absolute value of the DC charging voltage greater than that of the first DC charging voltage is applied, the potential difference being in a direction in which electrostatic force directed from the charging member to the image bearing member acts on the toner charged to the normal polarity, and wherein, in the cleaning operation, the control unit is configured to control the voltage application unit so that a third DC charging voltage having the same polarity as that of the second DC charging voltage and an absolute value of the DC charging voltage greater than that of the second DC charging voltage is applied after the second DC charging voltage is applied to the charging member.

19. The image forming apparatus according to claim 18, further comprising a second voltage application unit configured to apply a voltage to the developing member with the voltage application unit being referred to as a first voltage application unit, wherein the control unit is configured to control the first voltage application unit and the second voltage application unit so that a second developing voltage applied to the developing member when the surface of the image bearing member to which the second DC charging voltage is applied reaches the developing portion has an absolute value greater than that of a first developing voltage applied to the developing member when the surface of the image bearing member to which the first DC charging voltage is applied reaches the developing portion, and wherein the first developing voltage and the second developing voltage have a same polarity.

20. The image forming apparatus according to claim 18, further comprising an exposure unit configured to expose the surface of the image bearing member downstream of the transfer portion of the image bearing member and upstream of the charging portion in a rotation direction of the image bearing member, wherein the control unit is configured to control the DC charging voltage so that the potential difference in the direction in which the electrostatic force directed from the charging member to the image bearing member acts on the toner charged to the normal polarity is formed between the charging member and the image bearing member in the cleaning operation, and wherein the control unit is configured to control the exposure unit and the DC charging voltage so that no discharge occurs between the charging member and the image bearing member.

21. The image forming apparatus according to claim 18, wherein the control unit is configured to control the cleaning operation to be executed based on an environment where the image forming apparatus is used.

22. The image forming apparatus according to claim 21, further comprising a detection unit configured to detect the environment where the image forming apparatus is used, wherein the control unit is configured to, if the detection unit detects that the environment is a high-temperature high-humidity environment, control the cleaning operation to be executed.

23. The image forming apparatus according to claim 22, wherein the control unit is configured to calculate an absolute moisture content in air from the environment detected by the detection unit, and if the absolute moisture content is 15.0 $g/m^3$ or more, control the cleaning operation for the high-temperature high-humidity environment, to be executed.

24. The image forming apparatus according to claim 18, wherein the control unit is configured to control the cleaning operation to be executed based on a use state of the image bearing member.

25. The image forming apparatus according to claim 24, wherein the use state of the image bearing member is a cumulative number of rotations of the image bearing member.

26. The image forming apparatus according to claim 18, wherein the developing member is configured to collect residual toner remaining on the surface of the image bearing member, untransferred to the recording material in the image forming operation.

27. The image forming apparatus according to claim 26, wherein the toner is one-component developer.

* * * * *